US006623093B2

(12) United States Patent
Takahashi et al.

(10) Patent No.: US 6,623,093 B2
(45) Date of Patent: Sep. 23, 2003

(54) INK JET PRINTING APPARATUS AND INK JET PRINTING METHOD

(75) Inventors: Kiichiro Takahashi, Kanagawa (JP); Naoji Otsuka, Kanagawa (JP); Koichi Tanno, Kanagawa (JP); Minoru Teshigawara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/143,784

(22) Filed: May 14, 2002

(65) Prior Publication Data

US 2002/0196300 A1 Dec. 26, 2002

(30) Foreign Application Priority Data

May 17, 2001 (JP) ..... 2001-148008

(51) Int. Cl.[7] ..... B41J 29/38
(52) U.S. Cl. ..... 347/16
(58) Field of Search ..... 347/16, 15, 23, 347/14, 19, 65, 42, 105, 17, 12, 10, 7; 352/526; 400/582

(56) References Cited

U.S. PATENT DOCUMENTS 4,459,600 A 7/1984 Sato et al. ..... 347/47
4,558,333 A 12/1985 Sugitani et al. ..... 347/65
4,723,129 A 2/1988 Endo et al. ..... 347/56
4,740,796 A 4/1988 Endo et al. ..... 347/56
6,513,900 B2 * 2/2001 Endo et al. ..... 347/19
6,317,147 B1 * 11/2001 Tanaka ..... 347/116

* cited by examiner

*Primary Examiner*—Raquel Yvette Gordon
*Assistant Examiner*—Charles W. Stewart, Jr.
(74) *Attorney, Agent, or Firm*—Fitzpatrick, Cella, Harper & Scinto

(57) ABSTRACT

An ink jet printing apparatus is provided which can prevent a discharged paper-induced smear efficiently with a simple construction. To achieve this objective, the ink jet printing apparatus of this invention determines, based on an amount of ink ejected per unit area onto a preceding print medium last discharged to the discharge position by the discharging section, a required time duration that needs to elapse before a subsequent print medium being discharged toward the discharge position is allowed to contact a predetermined area of the preceding print medium and then controls a printing speed on the subsequent print medium so that the subsequent print medium will not contact the predetermined area of the preceding print medium within the time duration determined.

13 Claims, 29 Drawing Sheets

| FIG.18A |
| --- |
| FIG.18B |

| FIG.19A |
| --- |
| FIG.19B |

| PAPER SIZE | PAPER BENDING POSITION [inch] | |
|---|---|---|
| | BP1 | BP2 |
| A5 | 4 | 5 |
| A4 | 3 | 4 |
| A3 | 2 | 3 |

FIG.24

SMEAR TABLE

| PRINT DUTY | WAITING TIME (T1) [SEC] | | |
|---|---|---|---|
| | PRINT MODE 1 | PRINT MODE 2 | PRINT MODE 3 |
| Dmax ≧ 50% | 4 | 5 | 5 |
| 50% > Dmax ≧ 30% | 3 | 4 | 4 |
| 30% > Dmax | 2 | 3 | 3 |

FIG.25

| PAPER SIZE | REAR END WIDTH: PE [inch] | CORRECTION COEFFICIENT:CE |
|---|---|---|
| A5 | 4 | 0.5 |
| A4 | 3 | 0.5 |
| A3 | 2 | 0.4 |

FIG.26

| PAPER SIZE | PAPER BENDING POSITION [inch] | | | |
|---|---|---|---|---|
| | DISCHARGED PAPER SUPPORT NOT USED | | DISCHARGED PAPER SUPPORT USED | |
| | BP1 | BP2 | BP1 | BP2 |
| A5 | 4 | 5 | 4 | 5 |
| A4 | 3 | 4 | 5 | 9 |
| A3 | 2 | 3 | 6 | 14 |

FIG.27

INK JET PRINTING APPARATUS AND INK JET PRINTING METHOD

This application is based on Patent Application No. 2001-148008 filed May 17, 2001 in Japan, the content of which is incorporated hereinto by reference.

BACKGROUND OF THE INVENTION

1. Field of the Invention

The present invention relates to an ink jet printing apparatus for forming an image using a printing liquid (ink) and more particularly to an ink jet printing apparatus and an ink jet printing method which prevent an image quality degradation (smear) caused by a rubbing between print mediums during their discharge while minimizing a reduction in the efficiency of the printing operation. What is referred to here as "ink" includes not only those liquids used to attach desired colors to the print medium but also so-called transparent processing liquids applied to the print medium before or after the colors are applied.

In this specification, the printing or recording means having inks adhere to the print medium such as paper not only according to print data representing characters and images but also according to meaningless data, such as random data and solid print data.

2. Description of the Related Art

Printing apparatus such as printers, copying machines and facsimiles are intended to record images of dot patterns on a print medium, such as paper and a thin plastic sheet, according to image information.

The printing apparatus may be classified according to the printing system into an ink jet system, a wired dot system, a thermal system, a laser beam system, etc. Of these, the ink jet system (ink jet printing apparatus) ejects ink (printing liquid) droplets from nozzles of a print head and has them adhere to the print medium to form an image.

An increasing variety of printing apparatus has come to be used in recent years and there are growing demands on these printing apparatus for higher printing speed, higher resolution, higher print quality and reduced noise. Among the printing apparatus capable of meeting such requirements the ink jet printing apparatus can be cited.

In many of the ink jet printing apparatus, however, since inks used in the printing operation are aqueous liquids, they take time to be dried and fixed.

The problem about the fixing time tends to be recognized as an important problem of ink in accordance with improvement of the printing speed in recent years. That is, in a printing apparatus with a slow printing speed, there is a lot of time before the next page begins to be printed, and since fixing of the ink advances within the time, the fixing of the ink is not much of a problem. In recent printing apparatus capable of outputting five or more A4-size printed sheets in one minute, particularly those printing 10 sheets a minute, there is a possibility that a sheet of printed paper (or printed material) may be smeared by the ink on the previously printed paper when the previously printed paper and subsequently printed sheet contact each other. That is, when a printed sheet has an area printed with a somewhat high print duty, the next printed sheet is discharged before ink on the first printed sheet is completely dried. As a result, the second sheet may rub the incompletely dried portion of the first sheet. The phenomenon in which printed sheets are smeared with ink by the successively printed sheets rubbing each other is called a "smear" or "discharged paper-induced smear."

A conventional method commonly employed to solve the problem of smear during the paper discharging operation involves providing a fixing mechanism using a heater, or arranging in the printed sheet discharge mechanism a device for preventing a newly printed sheet from rubbing the previously printed sheet and then driving the printed sheet discharge mechanism when the printing is complete, thus successively stacking the printed sheets without smearing them.

The method that provides the mechanisms described above, however, is difficult to apply to small printers, particularly portable small printers. For example, the fixing mechanism using a heater can increase a power consumption and is required to have a heat insulation to prevent heat from adversely affecting circuits in the apparatus between other mechanism (for example, control circuit) in the apparatus and fixing mechanism. Considered in terms of running cost, apparatus size and apparatus cost, the fixing mechanism using a heater seems disadvantageous. That is, the use of the fixing mechanism will likely lead to an increase in the equipment size and cost. Particularly in a small portable printers using batteries, it is impractical to use the heater-based fixing mechanism with a large power consumption.

To prevent printed images from being rubbed during the printing operation, a system has also been proposed which has a printed sheet discharge mechanism that causes subsequently printed sheets to fall vertically onto the previously discharged sheets during the printed sheet stacking process. This mechanism, however, is complex and thus not suited for an ink jet printing apparatus that aims at a small size.

SUMMARY OF THE INVENTION

The present invention has been accomplished to solve the aforementioned problems and thereby provide an ink jet printing apparatus capable of preventing a discharged paper-induced smear with a simple construction.

To solve the problems described above, the present invention has the following construction.

According to one aspect, the present invention provides an ink jet printing apparatus which comprises: a print head for forming images by ejecting ink onto print mediums; a discharging means for discharging printed mediums successively to a predetermined discharge position; a duration determining means for determining, based on an amount of ink ejected per unit area onto a preceding print medium last discharged to the discharge position by the discharging means, a required time duration that needs to elapse before a subsequent print medium being discharged from the discharging means toward the discharge position is allowed to contact a predetermined area of the preceding print medium; a speed control means for controlling a printing speed on the subsequent print medium so that the subsequent print medium will not contact the predetermined area of the preceding print medium within the time duration determined by the duration determining means; a size detection means for detecting a size of the print mediums; and a modifying means for changing a timing of performing the printing speed control on the subsequent print medium according to a detection result produced by the size detection means.

According to another aspect of the invention, the ink jet printing apparatus may further comprise a discharged paper support means for supporting the discharged print medium, wherein the control means controls the printing speed on the subsequent print medium according to an operation state of the discharged paper support means and a detection result produced by the size detection means.

According to a further aspect, the invention provides an ink jet printing method which comprises the steps of: printing images by ejecting ink onto print mediums; discharging the printed mediums successively to a predetermined discharge position; determining, based on an amount of ink ejected per unit area onto a preceding print medium last discharged to the discharge position, a required time duration that needs to elapse before a subsequent print medium being discharged toward the discharge position is allowed to contact a predetermined area of the preceding print medium; controlling a printing speed on the subsequent print medium so that the subsequent print medium will not contact the predetermined area of the preceding print medium within the time duration determined by the duration determining step; detecting a size of the print mediums; and changing a timing of performing the printing speed control on the subsequent print medium according to a detection result produced by the size detection step.

In this invention with the construction described above, for printed portions where the ink fixing is complete, the printing operation can be done at high speed by continuing the printing operation without reducing the printing speed. For only those printed portions where the ink fixing is not complete and the discharged paper-induced smear is likely to occur, a delay printing can be activated before the front end of the subsequent print medium reaches the printed portions in question. Further, by setting the discharged paper-induced smear prevention control timing and the control on the paper discharge operation according to the size of the print medium, the smear control can be performed more efficiently, thereby minimizing a reduction in the printing speed while preventing the smear.

The above and other objects, effects, features and advantages of the present invention will become more apparent from the following description of embodiments thereof taken in conjunction with the accompanying drawings.

BRIEF DESCRIPTION OF THE DRAWINGS

FIG. 24 is a diagram showing a relation between each print medium and its paper bending positions in the first embodiment of the invention;

FIG. 25 is a smear table in the first embodiment of the invention;

FIG. 26 is a table showing a setting of a rear end width and a correction coefficient determined for each print medium in the first embodiment of the invention; and FIG. 27 is a table showing paper bending positions set for each print medium in a second embodiment of the invention.

DETAILED DESCRIPTION OF PREFERRED EMBODIMENTS

Embodiments of the present invention will now be described in detail by referring to the accompanying drawings.

Basic Construction

Figure 1:
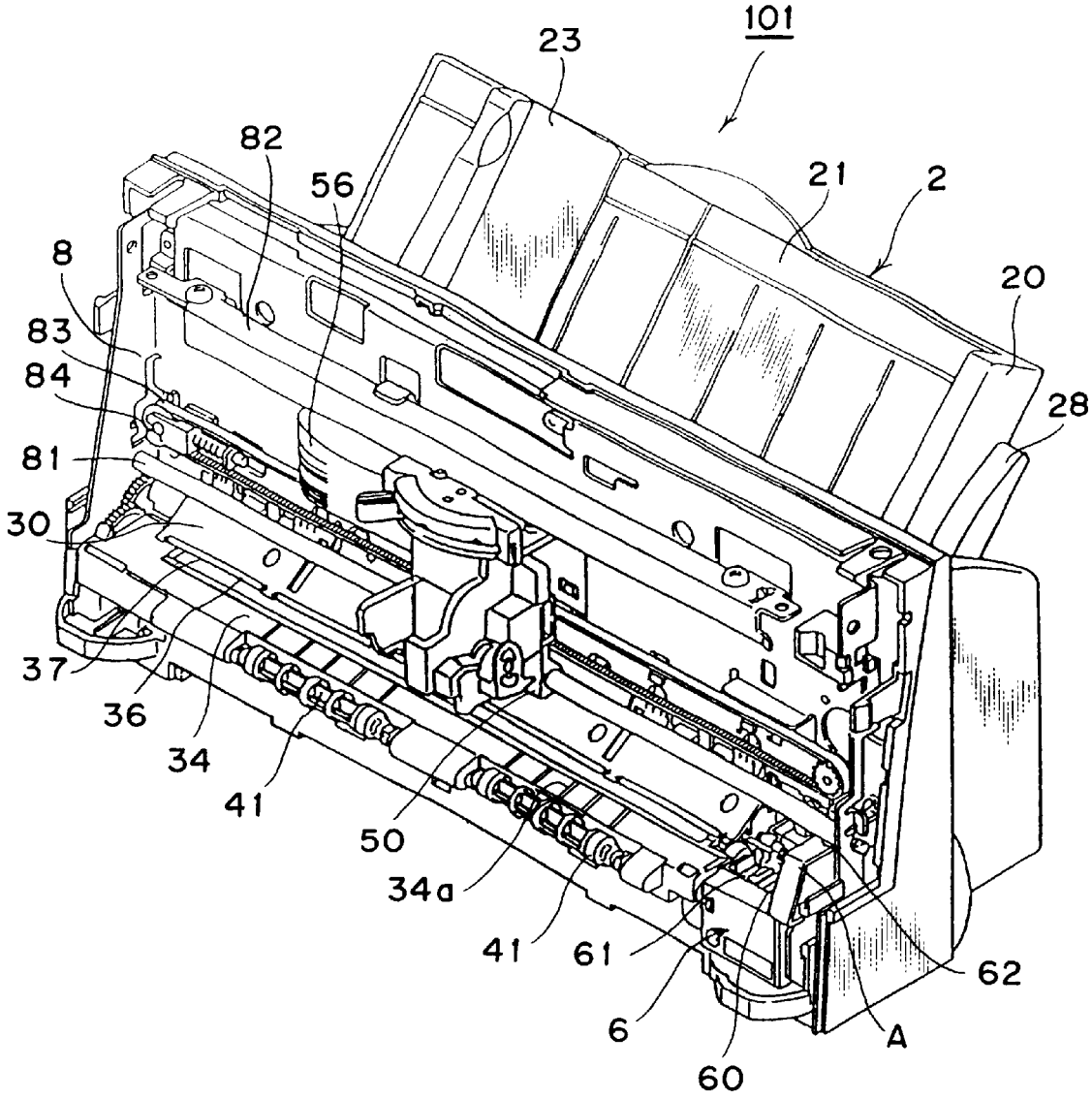
FIG. 1 is a perspective view showing an overall construction of an ink jet printing apparatus as one embodiment of the present invention.
Figure 2:
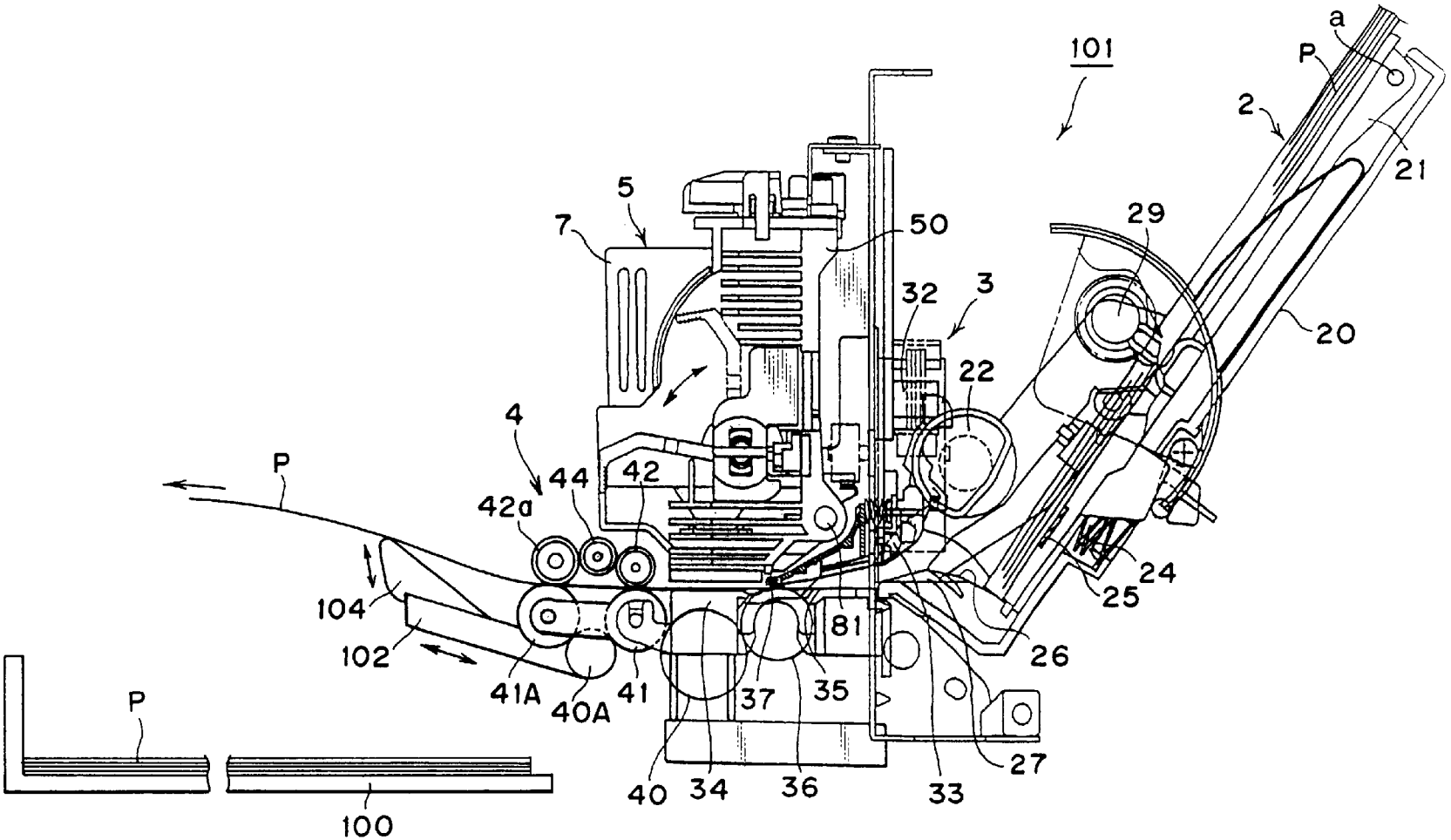
FIG. 2 is a side cross-sectional of the ink jet printing apparatus as one embodiment of the invention.

First, a basic construction of the ink jet printing apparatus as one embodiment of this invention will be described by referring to FIG. 1 and FIG. 2.

The ink jet printing apparatus 1 of this embodiment comprises mainly a paper supply unit 2, a paper feed unit 3, a paper discharge unit 4, a carriage unit 5, and a cleaning unit 6. The outline of these units will be explained. FIG. 1 is a perspective view showing an overall construction of the printing apparatus 1. FIG. 2 is a structural cross section of the printing apparatus 1 as seen from its side. With reference to FIG. 1 and FIG. 2, (I) paper supply unit, (II) paper feed unit, (III) carriage unit, (IV) cleaning unit and (V) paper discharge unit will be described.

(I) Paper Supply Unit

The paper supply unit 2 has mounted on a base 20 a pressure plate 21 on which to place print paper P and a supply roller 22 for supplying the print paper P. The pressure plate 21 has a movable side guide 23 to restrict the position where the print paper is placed. The pressure plate 21 is pivotable about a pivot shaft a connected to the base 20 and is urged toward the supply roller 22 by a pressure plate spring 24. At a part of the pressure plate 21 facing the supply roller 22 there is provided a separation pad 25 made from a material with a large friction coefficient, such as an artificial leather, to prevent a plurality of sheets of print paper P from being supplied simultaneously. Further, the base 20 has a separation claw 26 that covers corners of the print paper P at one end to separate the print paper one sheet at a time, and an integrally formed bank portion 27 which separates thick paper that cannot be dealt with by the separation claw 26. Further, a switch lever 28 and a release cam 29 are provided. The switch lever 28, when switched to a plain paper position, activates the separation claw 26 and, when switched to a thick paper position, deactivates it. The release cam 29 disengages the pressure plate 21 from the supply roller 22.

In the construction described above, during a standby state the release cam 29 keeps the pressure plate 21 pushed down to a predetermined position so that the pressure plate 21 is out of engagement with the supply roller 22. When in this state a drive force of a feed roller 36 is transmitted as by gear to the supply roller 22 and the release cam 29, the pressure plate 21 rises because the release cam 29 is separated from the pressure plate 21. As a result, the print paper P comes into contact with the supply roller 22 and, as the supply roller 22 rotates, the print paper P is picked up and supplied. At this time, the print paper P is separated by the separation claw 26 one sheet at a time and supplied to the paper feed unit 3. The supply roller 22 and the release cam 29 rotate until the print paper P is supplied into the paper feed unit 3, at which time the release cam 29 disengages the print paper P from the supply roller 22, bringing the paper supply unit into the standby state where the drive force from the feed roller 36 is cut off.

(II) Paper Feed Unit

The paper feed unit 3 (shown in FIG. 2) has a feed roller 36 for feeding the print paper P and a PE sensor 32. The feed roller 36 is provided with a pinch roller 37 that cooperates with the feed roller 36.

The pinch roller 37 is held rotatable on a pinch roller guide 30. A pinch roller spring 31 urges the pinch roller guide 30 to press the pinch roller 37 against the feed roller 36 to generate a force for feeding the print paper P. Further, at an inlet of the paper feed unit 3, into which the print paper P is transferred, are arranged an upper guide 33 and a platen 34 for guiding the print paper P. The upper guide 33 has a PE sensor lever 35 that notifies to the PE sensor 32 the detection of the front and rear ends of the print paper P.

In the construction described above, the print paper P transferred to the paper feed unit 3 is guided by the platen 34, pinch roller guide 30 and upper guide 33 and supplied between the feed roller 36 and the pinch roller 37. At this time, the PE sensor lever 35 detects the front end of the print paper P transferred and, based on the detection, the print position of the print paper P is determined. The print paper P is transferred on the platen 34 by the pair of rollers 36, 37 driven by a LF motor not shown.

A print head 7 used is an easily replaceable ink jet print head with a detachable ink tank. The print head 7 can apply heat to an ink as by a heater. The ink is film-boiled by the heat to produce a bubble, and the growth or contraction of the bubble produces a pressure change which in turn expels a drop of ink from a nozzle 70 of the print head 7 onto the print paper P, thus forming an image on it.

(III) Carriage Unit

The carriage unit 5 (FIG. 2) has a carriage 50 in which the print head 7 is mounted. The carriage 50 is supported by a guide shaft 81 for reciprocally moving the carriage in a direction perpendicular to the paper feed direction and by a guide rail 82 that holds the rear end of the carriage 50 and maintains a gap between the print head 7 and the print paper P. The guide shaft 81 and the guide rail 82 are mounted on a chassis 8. The carriage 50 is driven through a timing belt 83 by a carriage motor mounted on the chassis 8. The timing belt 83 is supported with an appropriate tension between a drive pulley 84*a* and an idle pulley 84*a*. The carriage 50 has a flexible printed circuit board 56 for transferring a head signal from an electric printed circuit board to the print head 7.

In the construction described above, when an image is to be formed on the print paper P, the pair of rollers 36, 37 feed the print paper P to a line position (position of the print paper P in the feed direction) where an image is to be formed and at the same time the carriage motor moves the carriage 50 to a column position (position of the print paper P in a direction perpendicular to the paper feed direction) where the image is to be formed, so that the print head 7 faces the image forming position. After this, according to a signal from the electric printed circuit board 9, the print head 7 ejects ink droplets toward the print paper P to form an image.

The attaching and detaching of the print head 7 to and from the carriage 50 and of the ink tank to and from the print head 7 are accomplished by pressing operation keys not shown to move the carriage 50 to a predetermined position where the mounting or demounting is done.

(IV) Cleaning Unit

The cleaning unit 6 (FIG. 1) comprises a pump 60 for cleaning the print head 7, a cap 61 for preventing the print head 7 from drying, and a drive switching arm 62 for switching a drive force from the feed roller 36 to the paper supply unit 2 and to the pump 60. Except during the paper supply and cleaning operations, the drive switching arm 62 fixes at a predetermined position a planetary gear (not shown), that would otherwise rotate about an axis of the feed roller 36, thus preventing the drive force of the feed roller 36 from being transmitted to the paper supply unit 2 and the pump 60. When, with the carriage 50 moved, the drive switching arm 62 is moved in the direction of arrow A, the planetary gear becomes free and thus is moved according to the forward and backward rotation of the feed roller 36. That is, when the feed roller 36 rotates forwardly, its drive force is transmitted to the paper supply unit 2. When the feed roller 36 reverses, the drive force is transmitted to the pump 60.

(V) Paper Discharge Unit

The paper discharge unit 4 (FIG. 2) has two discharge rollers 41, 41A, a transmission roller 40 in contact with the feed roller 36 and the discharge roller 41, and a transmission roller 40A in contact with the discharge roller 41 and the discharge roller 41A. Thus, the drive force of the feed roller 36 is transmitted through the transmission roller 40 to the discharge roller 41, from which it is further transferred through the transmission roller 40A to the discharge roller 41A.

Spurs 42, 42*a* are in contact with the discharge rollers 41, 41A so that they are rotatable following the discharge rollers 41, 41A. A cleaning roller 44 is rotatably in contact with the spurs 42, 42*a*. In this construction, the print paper P that was printed in the carriage unit 5 is clamped between the discharge rollers 41, 41A and the spurs 42, 42*a* and fed out into a discharge tray 100.

Provided downstream of the discharge roller 41A is a discharged paper support 104 described later that supports the print paper P that was printed and discharged. The discharged paper support 104 is rotatably mounted on a guide member 102. The guide member 102 is supported linearly movable between a position protruding from the platen 34 and a position retracted into the platen 34. According to the movement of the guide member 102 the discharged paper support 104 is rotated.

Next, the construction and operation of the print paper feed unit according to the present invention will be described with reference to FIG. 3 to FIG. 13.

Figure 3:
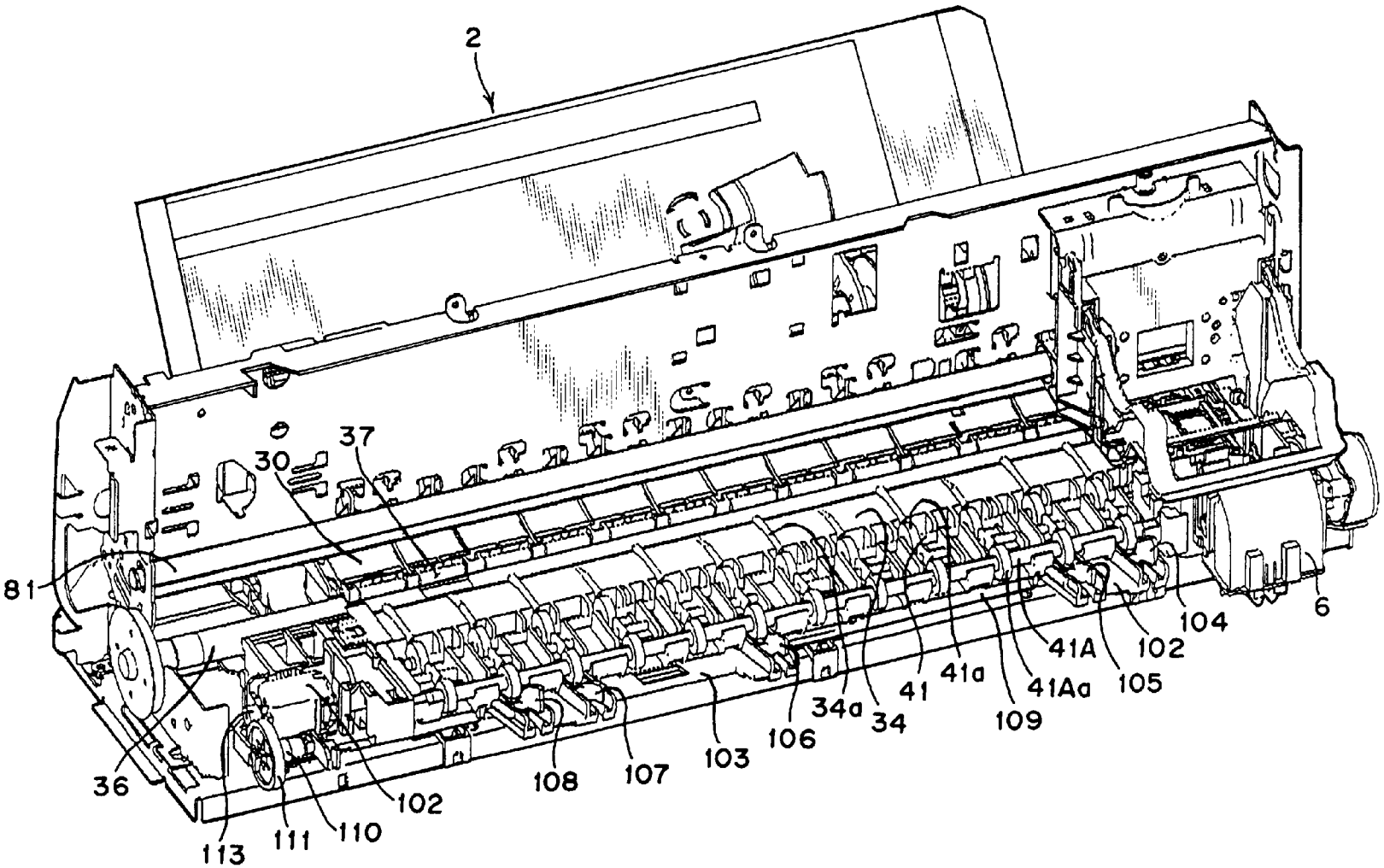
FIG. 3 is a perspective view showing a construction of a print medium feeding unit in the ink jet printing apparatus as one embodiment of the invention.
Figure 4:
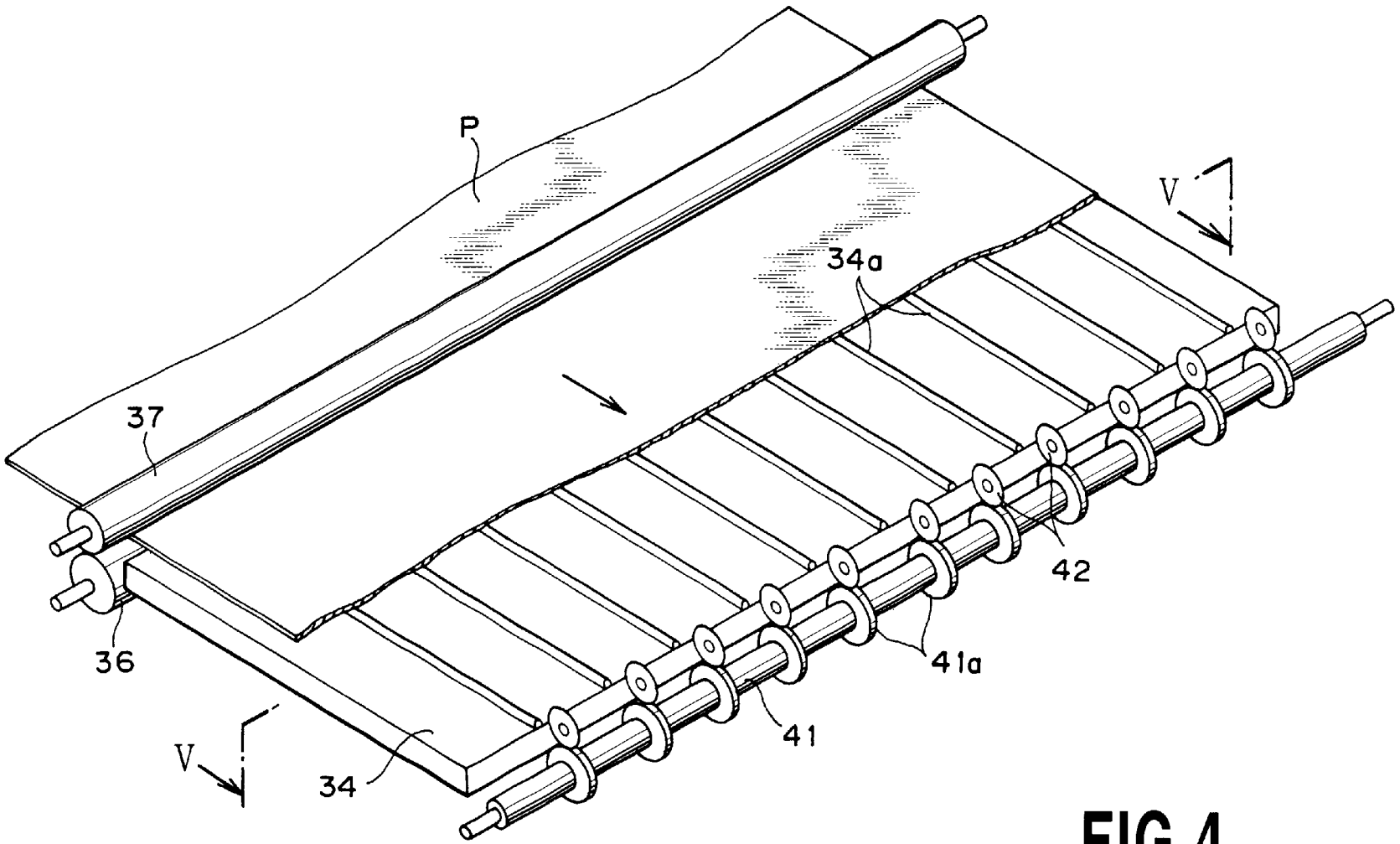
FIG. 4 is a perspective view schematically showing an essential part of a recording unit when the ink jet printing apparatus as one embodiment of the invention is in a printing state.
Figure 5:
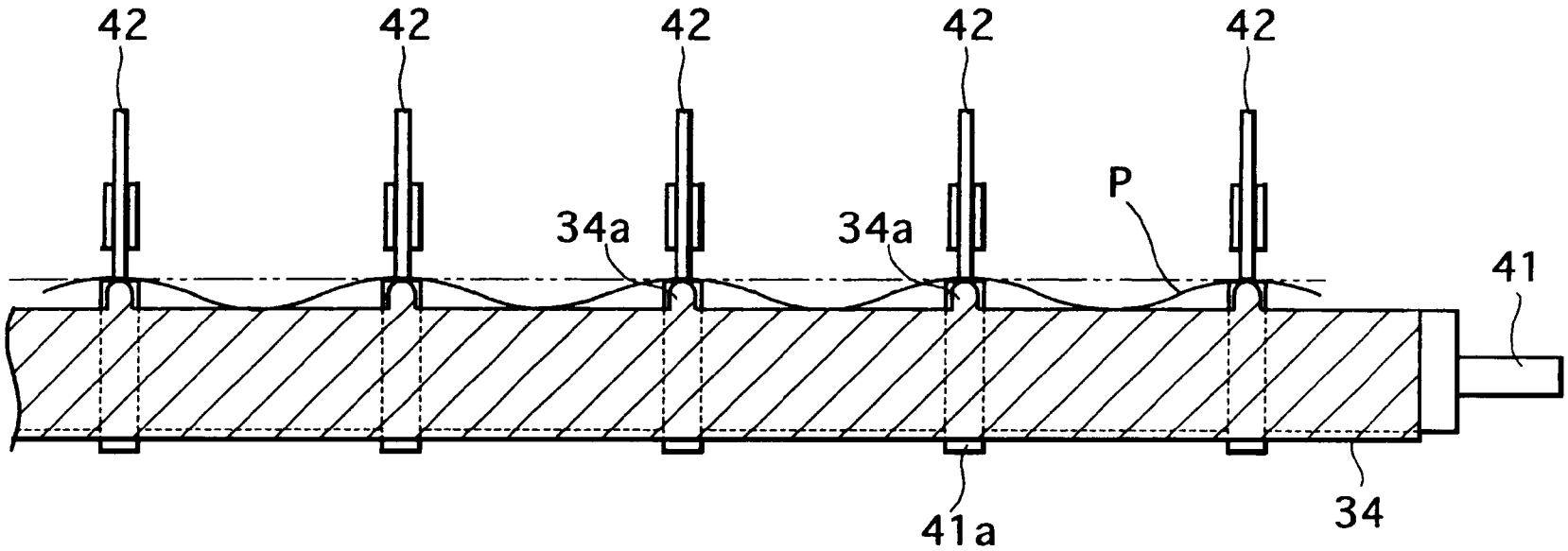
FIG. 5 is a cross-sectional view along V—V line of FIG. 4, showing how a cockling phenomenon occurs in the ink jet printing apparatus as one embodiment of the invention.
Figure 6:
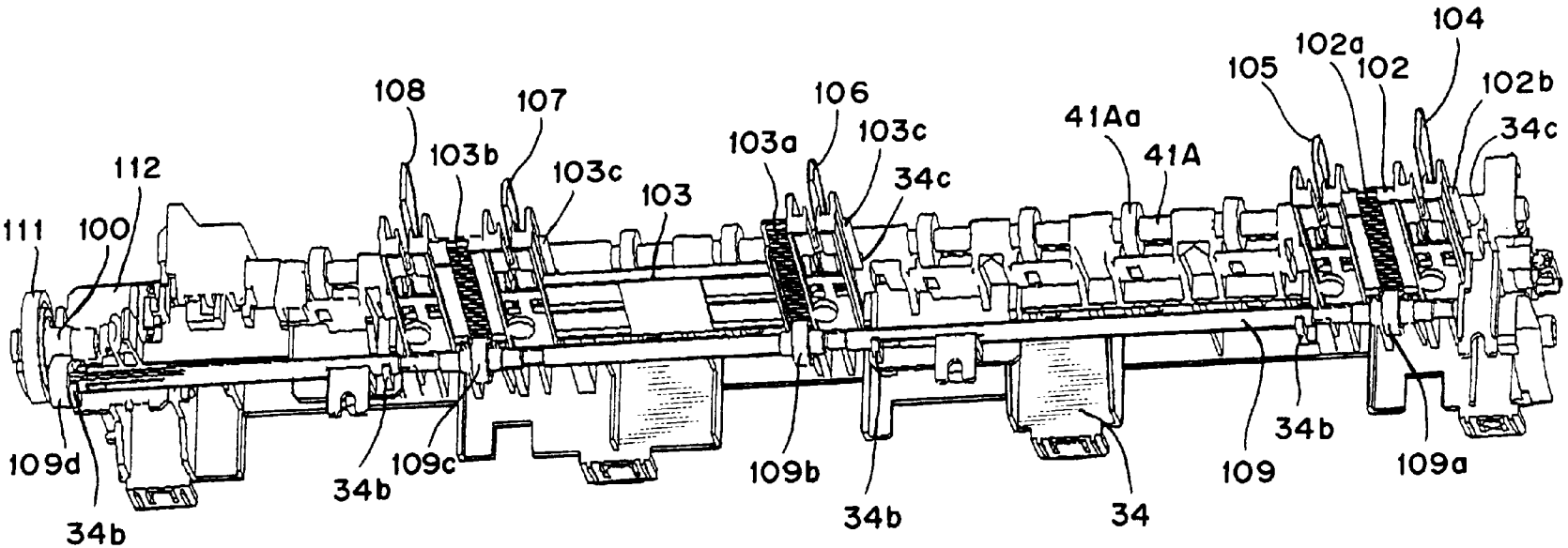
FIG. 6 is a perspective view, as seen from the bottom side, of an overall construction of a discharged paper support mechanism in the ink jet printing apparatus as one embodiment of the invention.
Figure 7:
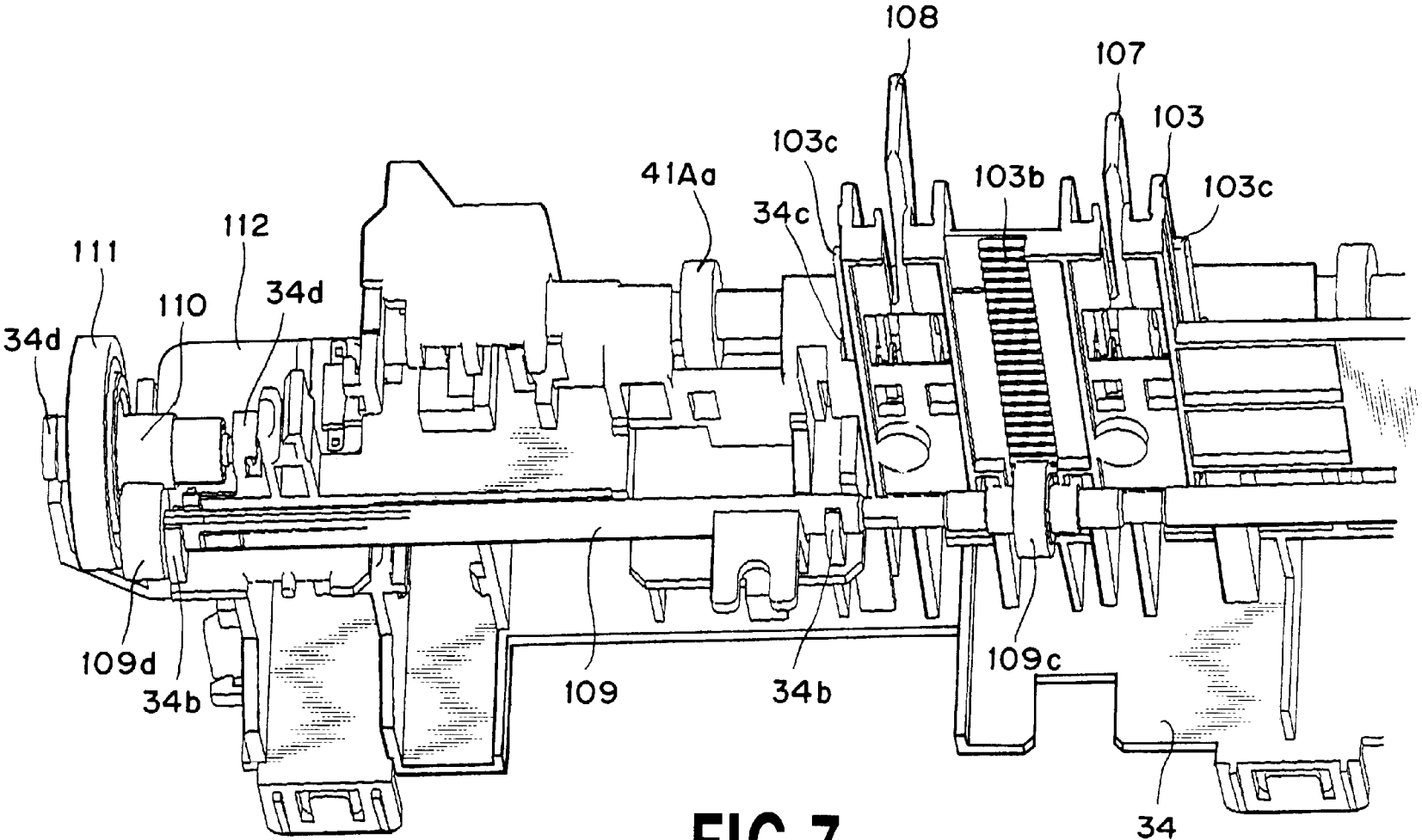
FIG. 7 is a partial, enlarged perspective view of FIG. 6.
Figure 8:
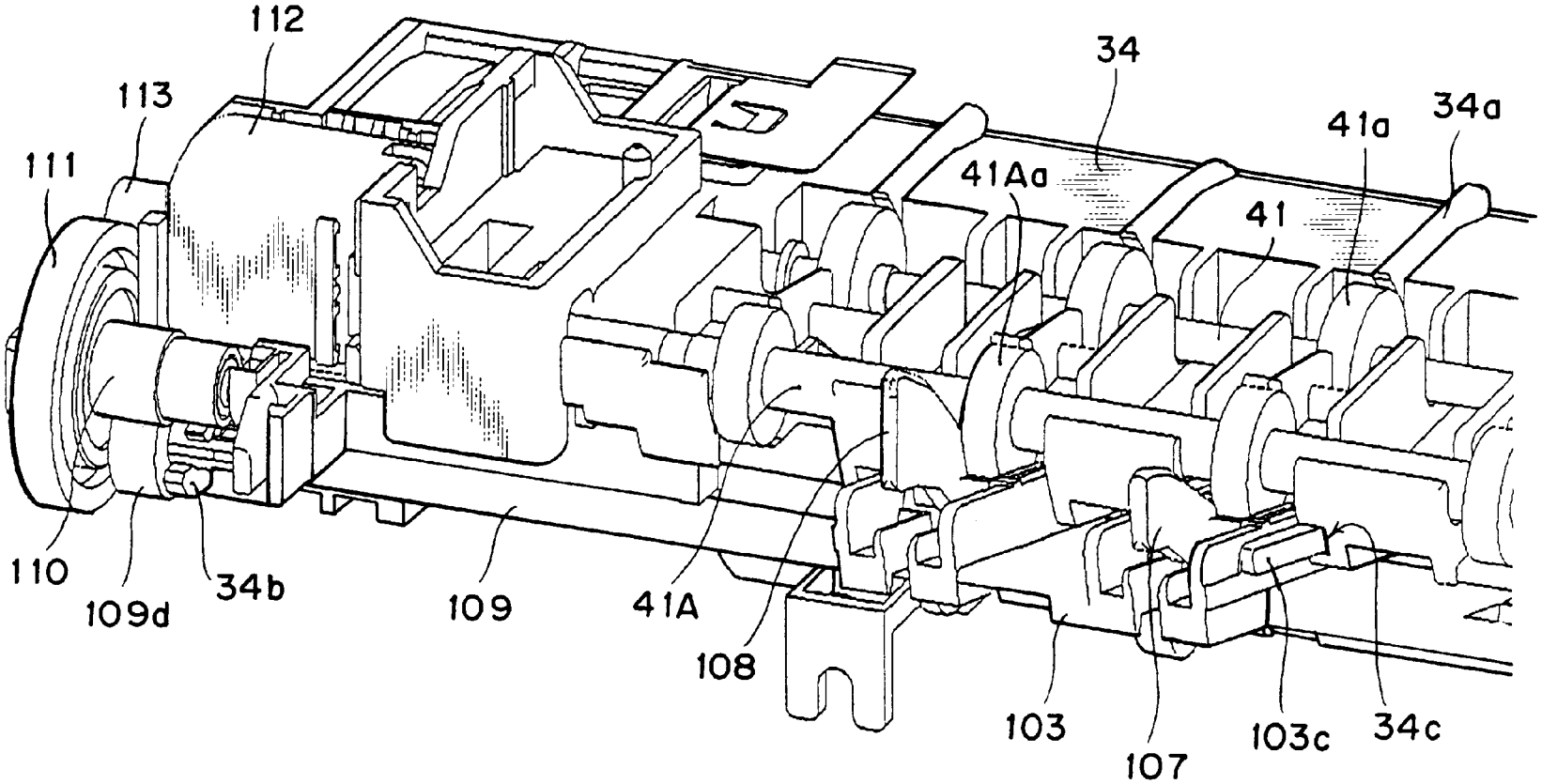
FIG. 8 is a partial, enlarged perspective view showing a drive unit of the discharged paper support mechanism in the ink jet printing apparatus as one embodiment of the invention.
Figure 9:
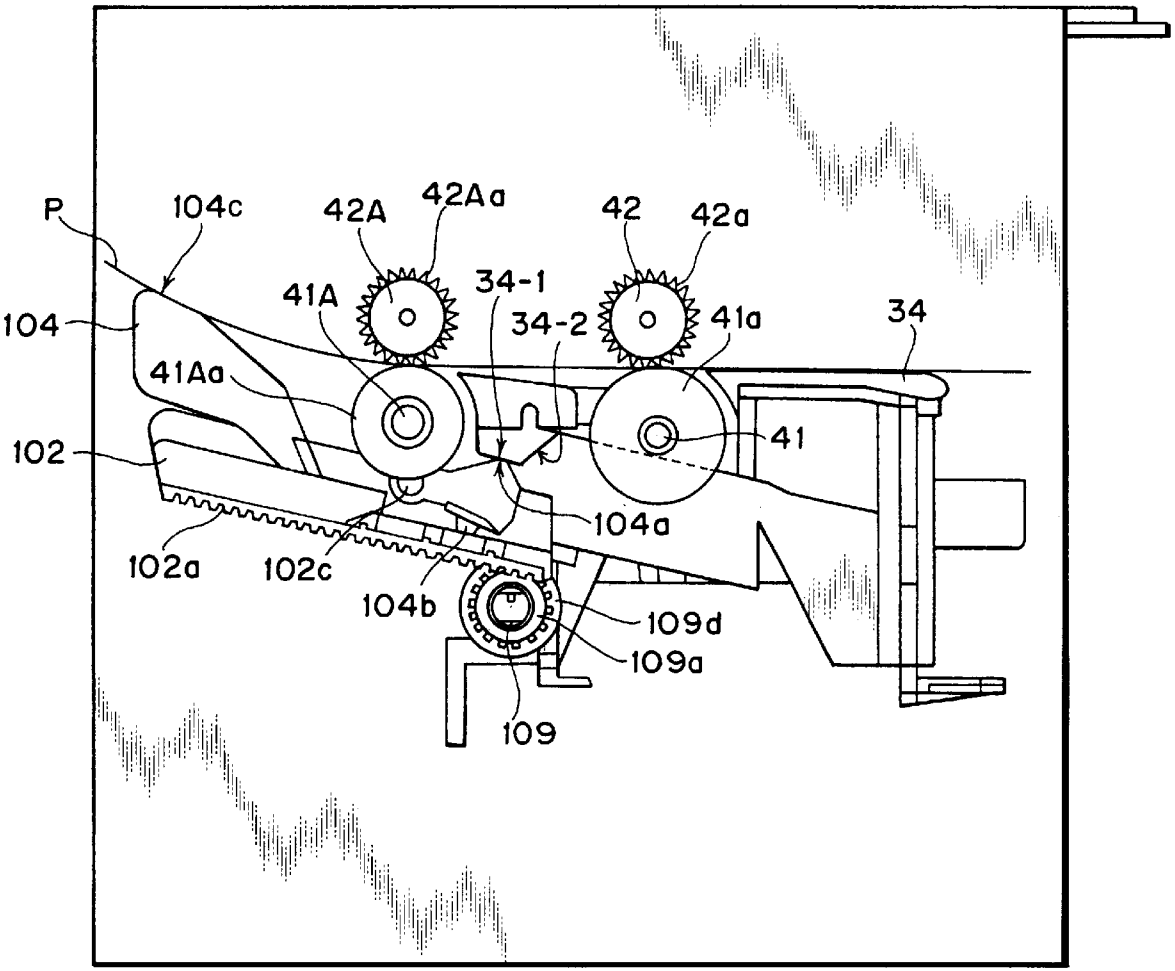
FIG. 9 is a side view of the discharged paper support mechanism in the ink jet printing apparatus as one embodiment of the invention, with a printed sheet supported by the mechanism.
Figure 10:
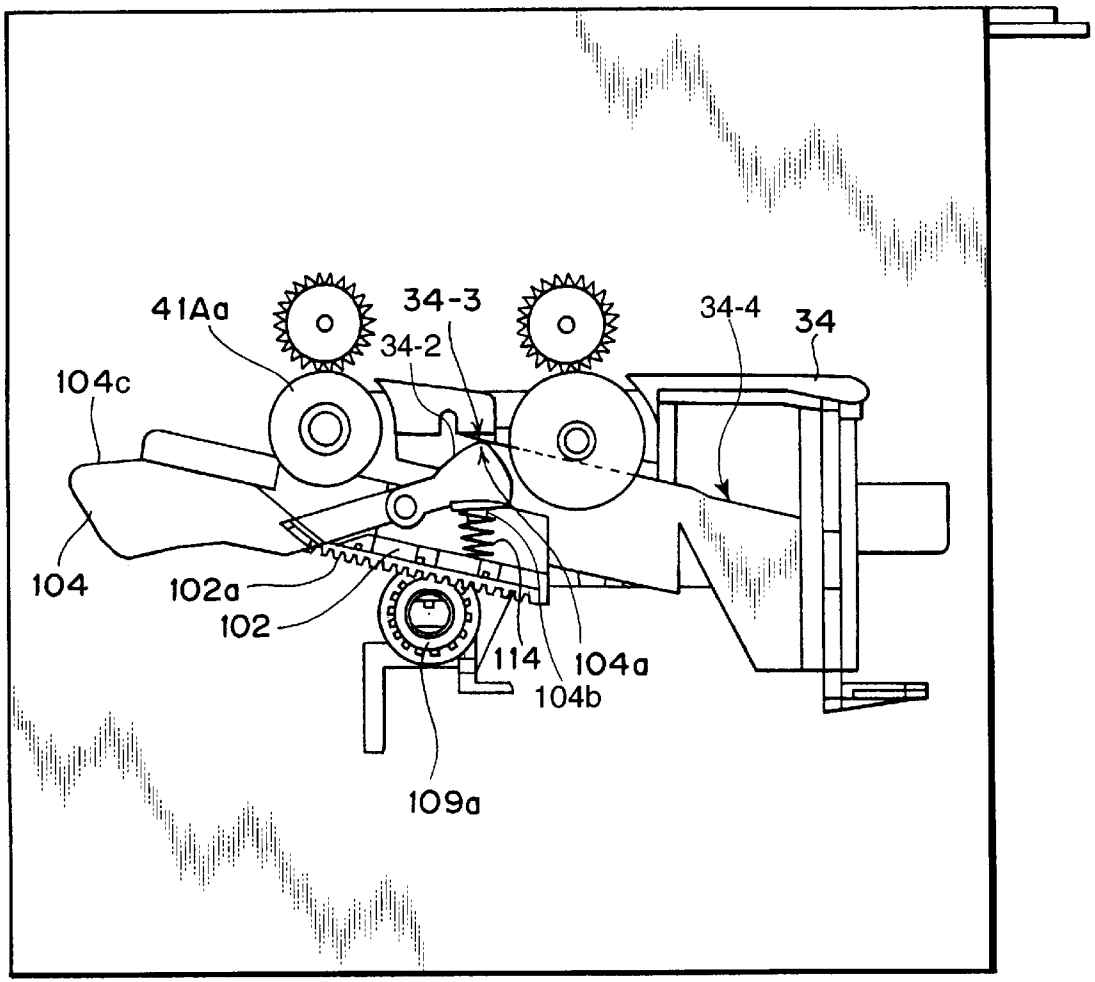
FIG. 10 is a side view of the discharged paper support mechanism in the ink jet printing apparatus as one embodiment of the invention, showing a printed paper support portion downstream of the discharged paper support located at the lowest point and a guide member protruding from a platen or being retracted into the platen.
Figure 11:
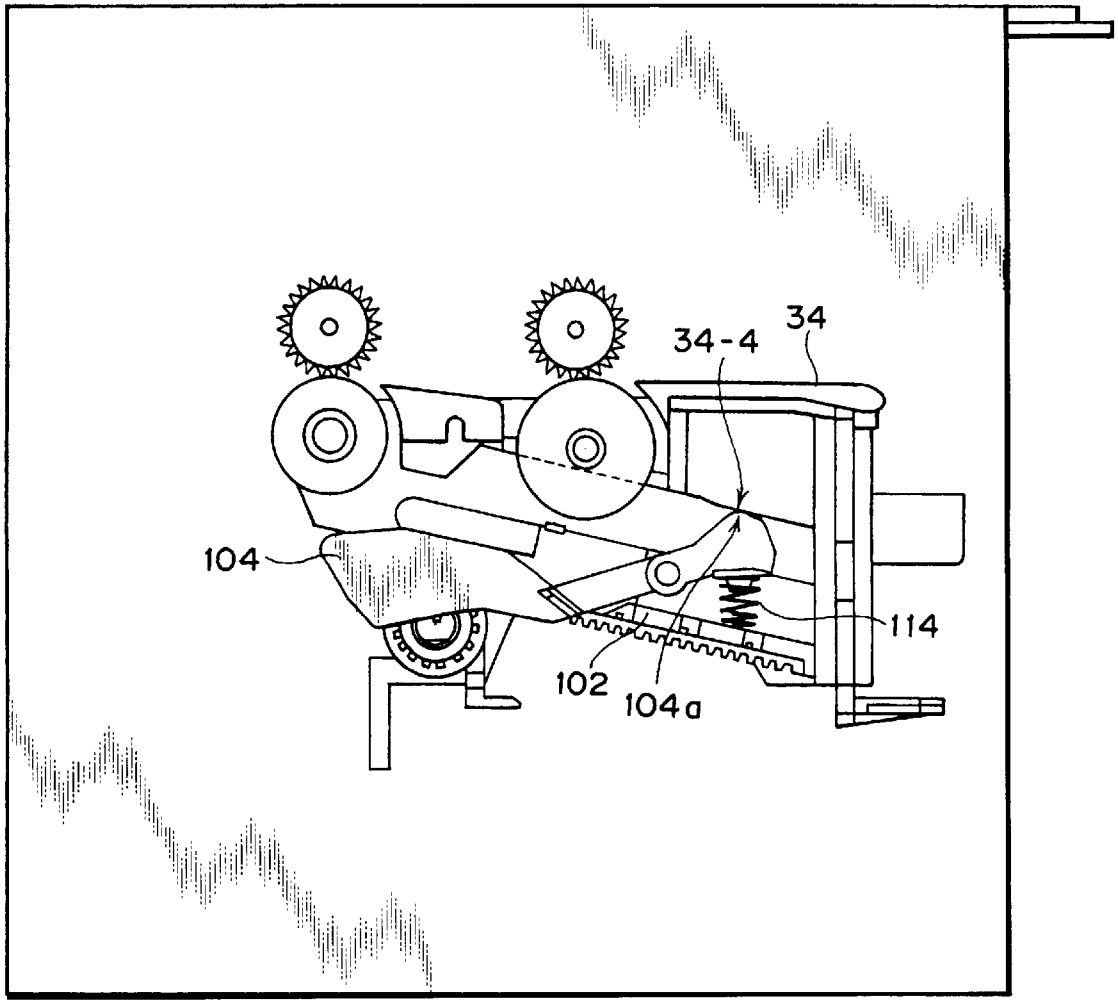
FIG. 11 is a side view of the discharged paper support mechanism in the ink jet printing apparatus as one embodiment of the invention when the discharged paper support mechanism is being retracted into the platen.

FIG. 3 is a perspective view showing the construction of the print paper feed unit and others in the printing apparatus 1; FIG. 4 is a perspective view schematically showing an essential part of a recording unit when the printing apparatus 1 is in a printing state; FIG. 5 is a partial, vertical, front cross-sectional view showing how a cockling phenomenon occurs during printing; FIG. 6 is a perspective view, as seen from the bottom side, of an overall construction of the discharged paper support mechanism of the printing apparatus 1; FIG. 7 is a partial, enlarged perspective view of FIG. 6; FIG. 8 is a partial, enlarged perspective view showing a drive unit of the discharged paper support mechanism of the ink jet printing apparatus 1; and FIGS. 9–11 are side views showing the discharged paper support mechanism of the ink jet printing apparatus 1 in an activated state.

In FIG. 3 to FIG. 11 the paper feed unit of the above construction operates as follows.

In FIG. 3 to FIG. 5, the platen 34 has a plurality of raised ribs 34*a* formed on the upper surface thereof which extend in the paper feed direction and are arranged at predetermined intervals in the direction of width of the print paper P.

Provided downstream of the platen 34 at positions corresponding to the ribs 34*a* are discharge rollers 41*a*, 41Aa, with which the spurs 42, 42*a* are in contact for rotation. The discharged paper supports 104–108 are provided downstream of the associated spurs 42A.

The drive force of the feed roller 36 is transmitted to the discharge rollers 41, 41A through the transmission rollers 40, 40A.

As described above, in the print area of the print paper P the gap between the print paper P and the print head 7 is kept at an appropriate distance by the feed roller 36 and the pinch roller 37 and by the discharge roller 41 and the spurs 42, and in this condition the print paper P is clamped between the discharge rollers 41, 41A and the spurs 42, 42*a* and fed.

The raised ribs 34*a* of the platen, the spurs 42, 42*a* and the discharged paper supports 104–108 are arranged on the same axes in the direction of paper feed in order to produce cockling efficiently during printing. Each of the cockles occurs between the ribs 34*a* of the platen 34 and curves downward (see FIG. 5).

Next, the construction of the discharged paper support mechanism will be explained.

In FIG. 3, the discharged paper supports 104–108 are provided downstream of the discharge roller 41A and supported on the platen 34 by the guide members 102, 103. The discharged paper supports 104–108 can be projected from and retracted into the platen 34.

The discharged paper supports 104–108 are provided at five locations spaced apart in the direction of width of the print paper P. The discharged paper supports when projected from the platen 34 guide the print paper P to above a plane where the print paper P is held horizontally in the print area.

When the print paper P is of A4 lateral width size, it is supported by the discharged paper supports 104, 105, 106; and when the print paper P is of A3 lateral width size, it is supported by all the supports 104–108 including the discharged paper supports 107, 108. In either case, the discharged paper supports are intended to flexibly bend down the print paper P at around its central part by its own weight.

That is, in the case of the A3 lateral width size as a reference size, the discharged paper supports 104 and 108 are formed in the same shape, and 105 and 107 in the same shape. Comparison between the discharged paper supports 104, 108 and the discharged paper supports 105, 107 shows that when they are projected from the platen, the uppermost downstream end (print paper support portion) of 104 (108) is higher in height position than that of 105 (107), i.e., 104 (108)>105 (107).

In the case of the A4 lateral width size, for which the paper is supported by the discharged paper supports 104, 105, 106, the uppermost downstream end of 106 is slightly higher than that of 105 (107), i.e., 105 (107)<106.

In this embodiment, when the print paper P of A3 lateral width size is printed at a low or medium density, the paper P is supported by the discharged paper supports 104, 106, 108. When the print paper P is printed at a high density, the paper is supported additionally by the discharged paper supports 105, 107 to prevent the paper P from buckling or bending inside the discharged paper supports 104 (108).

Thus, in this embodiment, although the heights of the uppermost downstream ends are so set that 105 (107)<106, it is also possible to make a setting of 105 (107)=106 or, if the difference is small, 105 (107)>106.

The discharged paper supports 104, 105 are supported rotatable about a shaft 102*c* of the guide member 102 of FIG. 9. Similarly, the discharged paper supports 106, 107, 108 are supported rotatable about a shaft 103*c* of the guide member 103 (not shown in FIG. 9).

The discharged paper supports 104–108 have the similar construction and thus explanations will be given only to the discharged paper support 104 as a representative.

As shown in FIG. 9, the discharged paper support 104 is so shaped that an upper part of its downstream print paper support portion 104*c* inclines, progressively rising toward the downstream side. The inclined portion contacts the front end of the printed paper, which is then moved along and supported by the inclined portion for smooth discharging.

The discharged paper support 104 has on the upstream side a cam protrusion 104*a* which engages cam rails 34-1 to 34-4, described later, of the platen 34 to determine the height position of the downstream print paper support portion 104*c* of the discharged paper support 104.

At a lower part of the upstream portion of the discharged paper support 104 is provided a boss 104*b* which is attached with one end of a spring 114 shown in FIG. 10 and FIG. 11. The other end of the spring 114 is pressed against the guide member 102. The force of this spring keeps the cam protrusion 104*a* in stable contact with the cam rails 34-1 to 34-4 at all times.

As described above, the discharged paper supports 104, 105 are rotatably supported by the guide member 102, and the discharged paper supports 106, 107, 108 are rotatably supported by the guide member 103.

On both sides of the guide member 102 are provided raised guide rails 102*b* that movably fit in guide grooves 34*c* formed in the platen 34. The guide member 102 linearly moves, with its guide rails 102*b* sliding in the guide grooves 34*c* of the platen 34.

The guide member 103 also has the similar structure, except that it has three raised guide rails 103*c* fitted in their associated guide grooves 34*c* of the platen 34.

The guide member 102 has a rack 102*a* fixedly mounted on its bottom portion at one location, and the guide member 103 has racks 103*a*, 103*b* fixedly mounted on its bottom portion at two locations.

Below the platen 34 is provided a drive shaft 109 which is rotatably supported by bearings 34*b* provided on the platen 34. The drive shaft 109 has pinion gears 109*a*–109*c* in mesh with the racks 102*a*, 103*a*, 103*b* of the guide members 102, 103. Rotating the pinion gears 109*a*–109*c* moves the guide members 102, 103.

The pinion gear 109*a* meshes with the rack 102*a*, the pinion gear 109*b* with the rack 103*a*, and the pinion gear 109*c* with the rack 103*b*.

As described above, the guide members 102, 103 are moved linearly by the rotation of the drive shaft 109 either to project from the platen 34 or retract into the platen 34. The guide members 102, 103 abut against the platen 34 at predetermined positions to be set at their initial positions.

The drive shaft 109 has a gear 109*d* at one end which meshes with a transmission gear 110. A transmission gear 111 arranged coaxial with the transmission gear 110 meshes with a motor gear 113 of a motor 112 (see FIG. 8). The transmission gear 110 and the transmission gear 111 are supported on a shaft (not shown) rotatably supported by bearings 34*d* (see FIG. 7) installed in the platen 34.

Between the transmission gear 110 and the transmission gear 111 is installed a torque limiter (not shown) that is urged by a spring not shown. Hence, when the guide members 102, 103, driven by the drive force of the motor 112 through these gears, abut against the platen 34 and stop, the torque limiter prevents backlash between the pinion gears 109*a*, 109*b*, 109*c* and the racks 102*a*, 103*a*, 103*b*.

Next, the operation of the discharged paper supports will be explained.

In this embodiment, the discharged paper supports 104–108 protrude from the platen 34 before the print head starts printing and retract simultaneously with the paper discharge operation after the printing operation.

When the motor 112 starts, the motor gear 113 is rotated to transmit the drive force to the transmission gear 111, from which it is transferred to the transmission gear 110 engaged with the transmission gear 111 to rotate the drive shaft 109 through the gear 109*d*.

The guide members 102, 103 are moved linearly by the racks 102*a*, 103*a*, 103*b* meshing with the pinion gears 109*a*–109*c* mounted on the drive shaft 109.

Referring to FIGS. 9–11, FIG. 9 shows the discharged paper support 104 projected out to support the print paper P; FIG. 10 shows the downstream print paper support portion 104*c* of the discharged paper support 104 situated at the lowest point and the guide member 102 being retracted from the projected position into the platen 34; and FIG. 11 shows the guide member 102 retracted in the platen 34.

The discharged paper supports 104–108 perform the same operations and thus explanations will be given only to the discharged paper support 104 as a representative.

In FIG. 11, the guide member 102 is retracted in the platen 34 at a predetermined position and the discharged paper support 104 is accommodated in the guide member 102. In this standby state the cam protrusion 104*a* is kept in contact with the cam rail 34-4 of the platen 34 by the spring 114.

As the pinion gear 109*a* of the drive shaft 109 rotates, the rack 102*a* in mesh with the pinion gear 109*a* causes the guide member 102 to start protruding, with the result that the cam protrusion 104*a* of the discharged paper support 104 slides along the cam rails 34-4, 34-3 of the platen 34 against the force of the spring 114 (FIG. 10).

When the downstream print paper support portion 104*c* of the discharged paper support 104 moves past the discharge roller 41Aa and the cam protrusion 104*a* engages a sloped surface 34-2 of the cam rail, the cam protrusion 104*a* is pushed down to cause the downstream print paper support portion 104*c* of the discharged paper support 104 to gradually move up. When the cam protrusion 104*a* engages the most downstream surface 34-1 of the cam rail, the print paper support portion 104*c* of the discharged paper support 104 reaches its highest position, the guide member 102 abuts against the platen 34 at a predetermined position and stops and the print paper support portion 104*c* is held at a predetermined position.

Then, after the front end of the print paper P passes the spurs 42, the print paper P contacts the upper inclined surface of the discharged paper support 104, moves along the inclined surface and is supported by the print paper support portion 104*c* situated at the uppermost end portion on the downstream side (see FIG. 9).

The discharged paper support function can be realized with the construction and operation described above.

The timing of projecting or retracting the discharged paper supports and the guide member is controlled by a control means in synchronism with the size and print area of the print paper P.

Although in this embodiment the timing of projecting the discharged paper supports 104–108 is before the print head starts printing, they may be projected during the printing operation if the printed image is not adversely affected.

While in this embodiment the guide members 102, 103 are provided at positions facing the print head and are projected from or retracted into the platen 34 that supports the print medium, it is also possible to provide a dedicated holding member (not shown) downstream of and separately from the platen 34 for holding the guide members 102, 103 so that the guide members can be projected from or retracted into the dedicated holding member.

Since the raised ribs 34*a* of the platen, the spurs 42 and the discharged paper supports 104–108 are arranged on the same straight line in the direction of feed of the print paper P, the cockles produced are not disturbed by the discharged paper supports.

When a dedicated print medium (thick paper) that will produce almost no cockling is used, the rigidity of the paper itself is high and thus the printing and paper discharging may be done without projecting the discharged paper supports from the platen 34.

Figure 12:
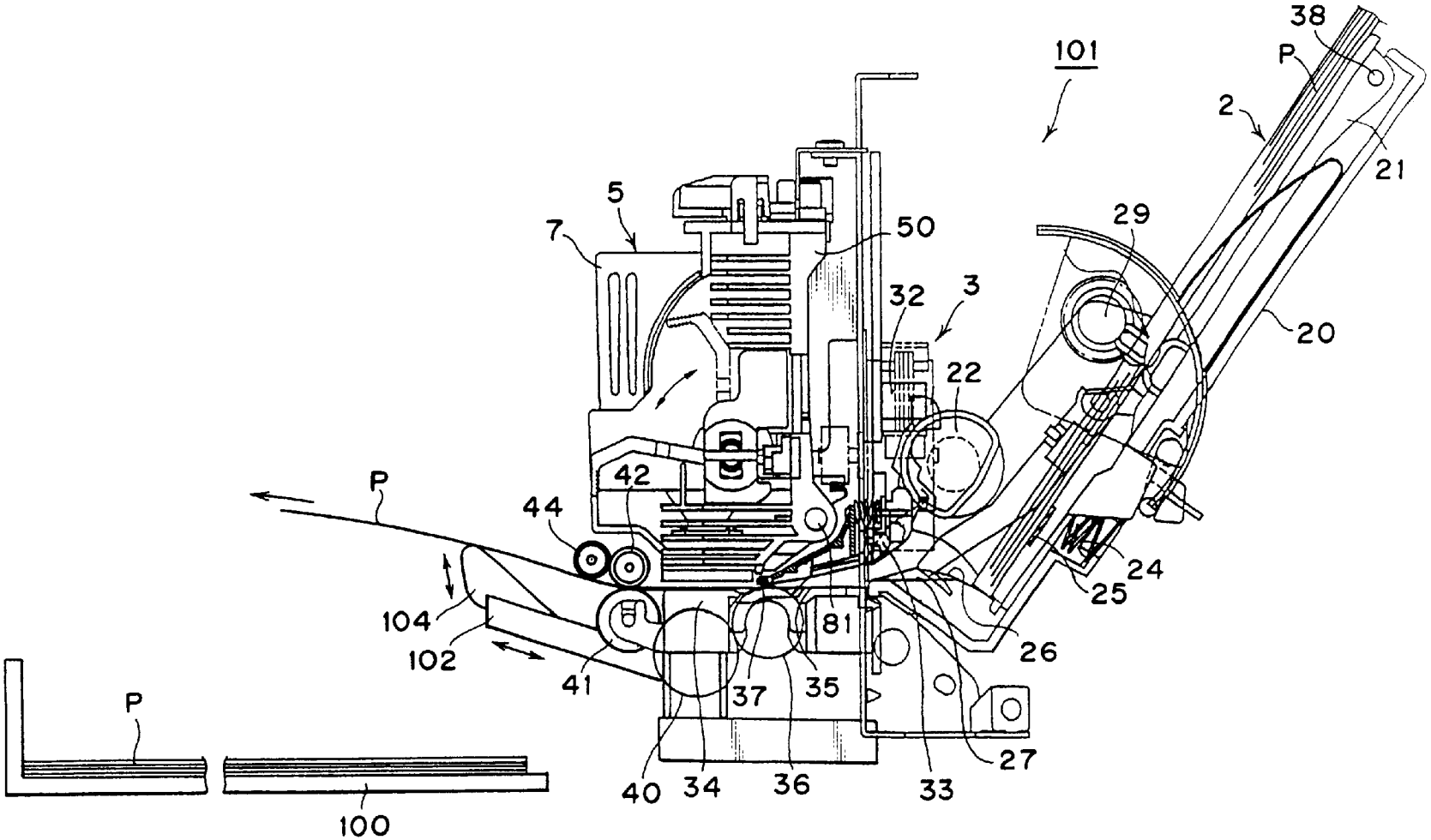
FIG. 12 is a structural cross-sectional view of a variation of the ink jet printing apparatus as one embodiment of the invention.

Next, a variation of the above embodiment will be explained in which, as shown in FIG. 12, the discharge roller 41 and the spur 42 are paired and arranged in line.

In the discharge unit, the drive force of the feed roller 36 is transmitted to the discharge roller 41 by the transmission roller 40.

The discharged paper support 104 is arranged downstream of the spur 42 on the same straight line in the paper feed direction. Since the discharge roller 41 and the spur 42 are paired and arranged in line, the space occupied by this apparatus is further reduced from the one shown in FIG. 2.

Figure 13:
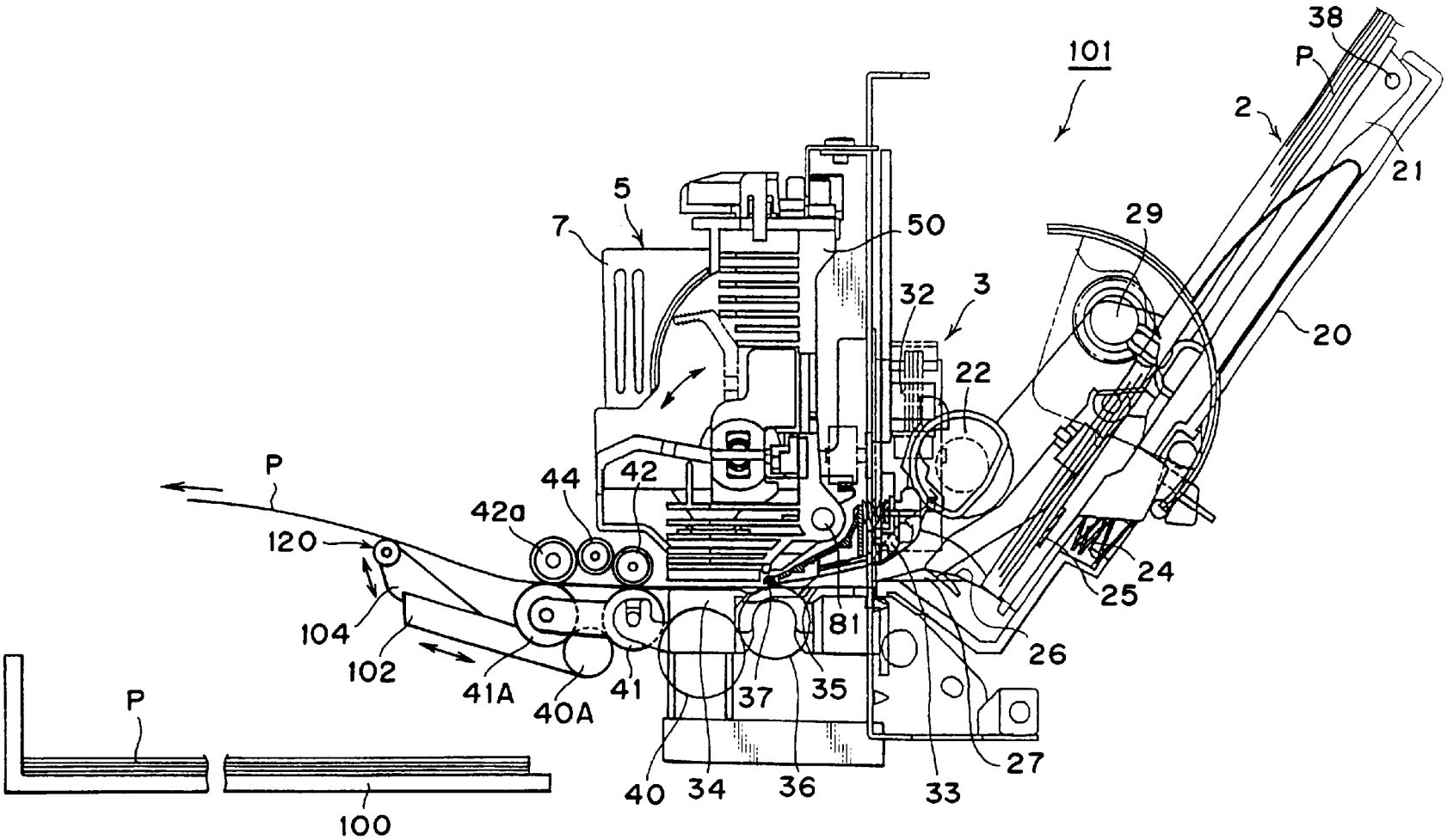
FIG. 13 is a cross-sectional view of another variation of the ink jet printing apparatus as one embodiment of the invention.

As shown in FIG. 13, a roller 120 may rotatably mounted on a downstream portion of the discharged paper support 104 to support the print paper P to reduce the resistance produced when the print paper is discharged.

Since all of the discharged paper supports arranged, though not shown, in the direction of width of the print paper P are provided with the roller 120, the print paper P can be fed with high precision, maintaining the high quality of the printed image.

As described above, in the ink jet printing apparatus of this invention, the guide member 102 is constructed to be able to project from and retract into the platen 34 and the discharged paper support 104 is formed pivotable to project from and retract into the guide member 102. This construction can reduce the space occupied by the operation of the discharged paper support mechanism when the discharged paper support member is arranged almost in line with the discharge roller or spur in the direction of paper feed.

The reduced space can increase the strength of the platen, which in turn makes it easy to form the upper surfaces of the rib portions to a desired flatness and to set the print head-to-paper distance to a predetermined value.

Characteristic Construction

In the following, embodiments having constructions characteristic of this invention will be described in detail by referring to the accompanying drawings. Throughout these drawings, parts represented by the same reference numbers denote the same or corresponding parts.

First Embodiment

A first embodiment of a construction characteristic of this invention will be explained.

Figure 14:
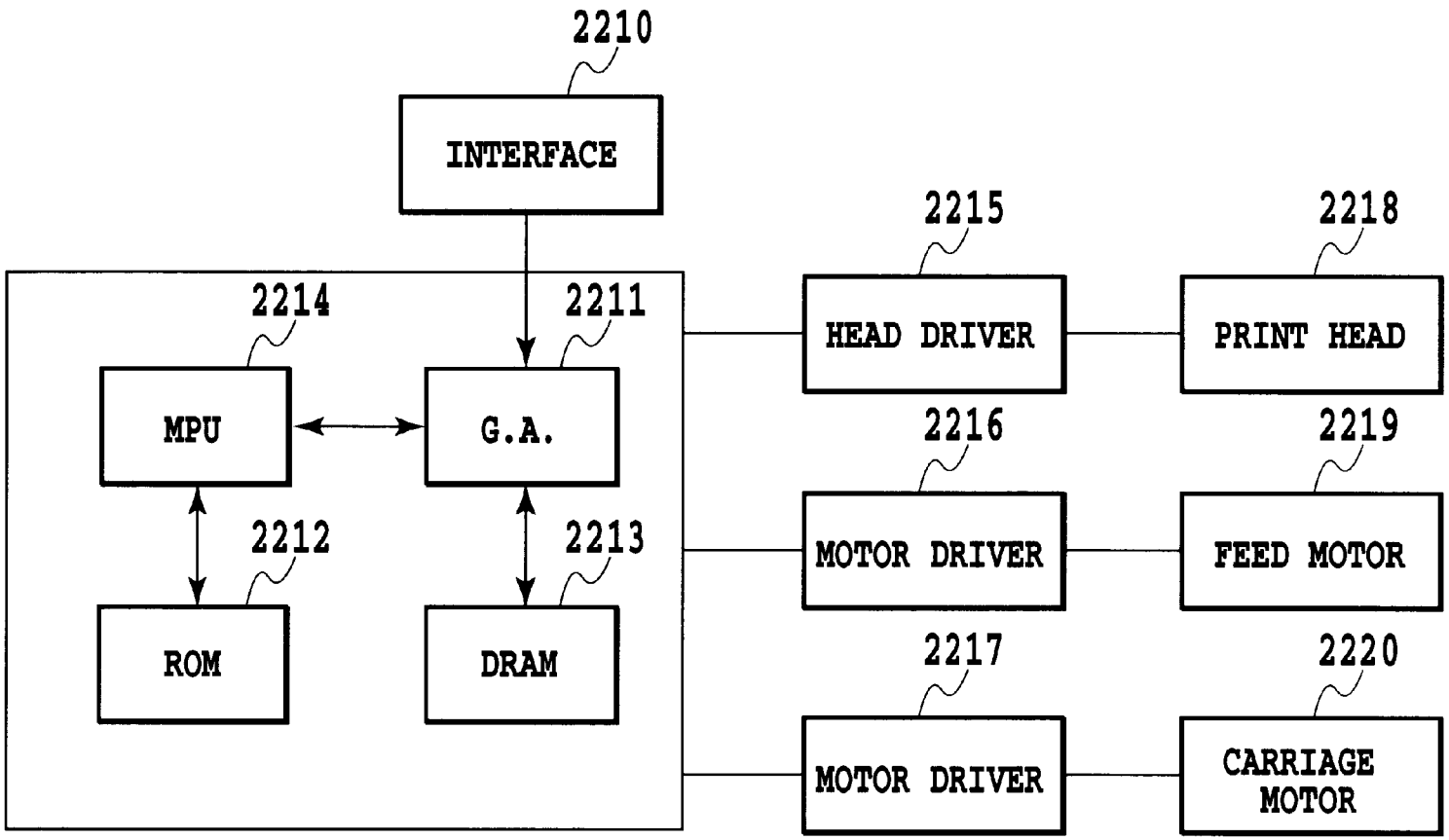
FIG. 14 is a block diagram schematically showing a control system configuration in the ink jet printing apparatus as one embodiment of the invention.

The first embodiment performs the following control operation in the ink jet printing apparatus having a configuration shown in FIG. 14.

When there is an area on a print medium that was printed with a print duty higher than a predetermined value, the ink jet printing apparatus of the first embodiment memorizes a position on the print medium of that area printed with a high print duty and sets a time for completing the ink fixing of the high print duty area. Then, during the process of printing, before a front end of a print medium currently being printed comes into contact with a printed medium that has already been discharged at a paper discharge position by the immediately preceding printing operation, the printing apparatus checks whether ink on that area of the printed, discharged medium that the front end of the current print medium will contact is already fixed. When it is found that the ink fixing is not complete, a print speed control or smear prevention control is performed to prevent a possible smear. As the print speed control the first embodiment performs a delay print control which stops the printing operation until the ink fixing of the area to be contacted is complete and, after the ink fixing is complete, resumes the printing operation.

That is, it is checked by time whether the ink fixing of the area of the high printing duty is complete until the end of the subsequent print paper contacts the high print duty area of previously printed paper. When the fixing is not complete, printing operation is made to stop, it wait for time to complete fixing, and printing is made to resume.

Depending on the size of the print medium used or the printing scan width, the timing of performing the smear prevention control (print speed control) is changed to efficiently prevent the print medium currently being discharged from smearing the previously printed medium.

Now, the smear prevention control executed in this embodiment will be explained in more detail.

First, with reference to the block diagram of FIG. 14, the configuration of the control system in this embodiment will be described.

In FIG. 14, reference numeral 2210 represents an interface and 2211 a gate array. Denoted 2212 is a ROM, 2213 a DRAM and 2214 an MPU. 2215 denotes a head driver, 2216 a paper feed motor driver, and 2219 a paper feed motor. 2217 represents a motor driver for a carriage motor and 2220 a carriage motor.

In the control system with the above configuration, when print data is supplied from a host through the interface 2210, the print data is stored temporarily in the DRAM 2213 through the gate array 2211. Then, the data in the DRAM 2213 is converted by the gate array 2211 from raster data into a print image to be printed by the print head 2218 and then is stored again in the DRAM 2213. The data in the DRAM 2213 is again transferred by the gate array 2211 through the head driver 2215 to the print head 2218, which ejects ink from associated nozzles to perform printing. A dot counter is formed on the gate array 2211 to count the number of dots printed at high speed.

The carriage motor 2220 is operated by the carriage motor driver 2217 to move the print head 2218 in the main scan direction according to the dot forming speed of the print head. Here, the CPU 2214 executes an interrupt control on the gate array 2213 every 10 msec to read an accumulated counter value representing the number of printed dots. It is thus possible to calculate a print duty per unit area from the number of printed dots per unit time.

Figure 15:
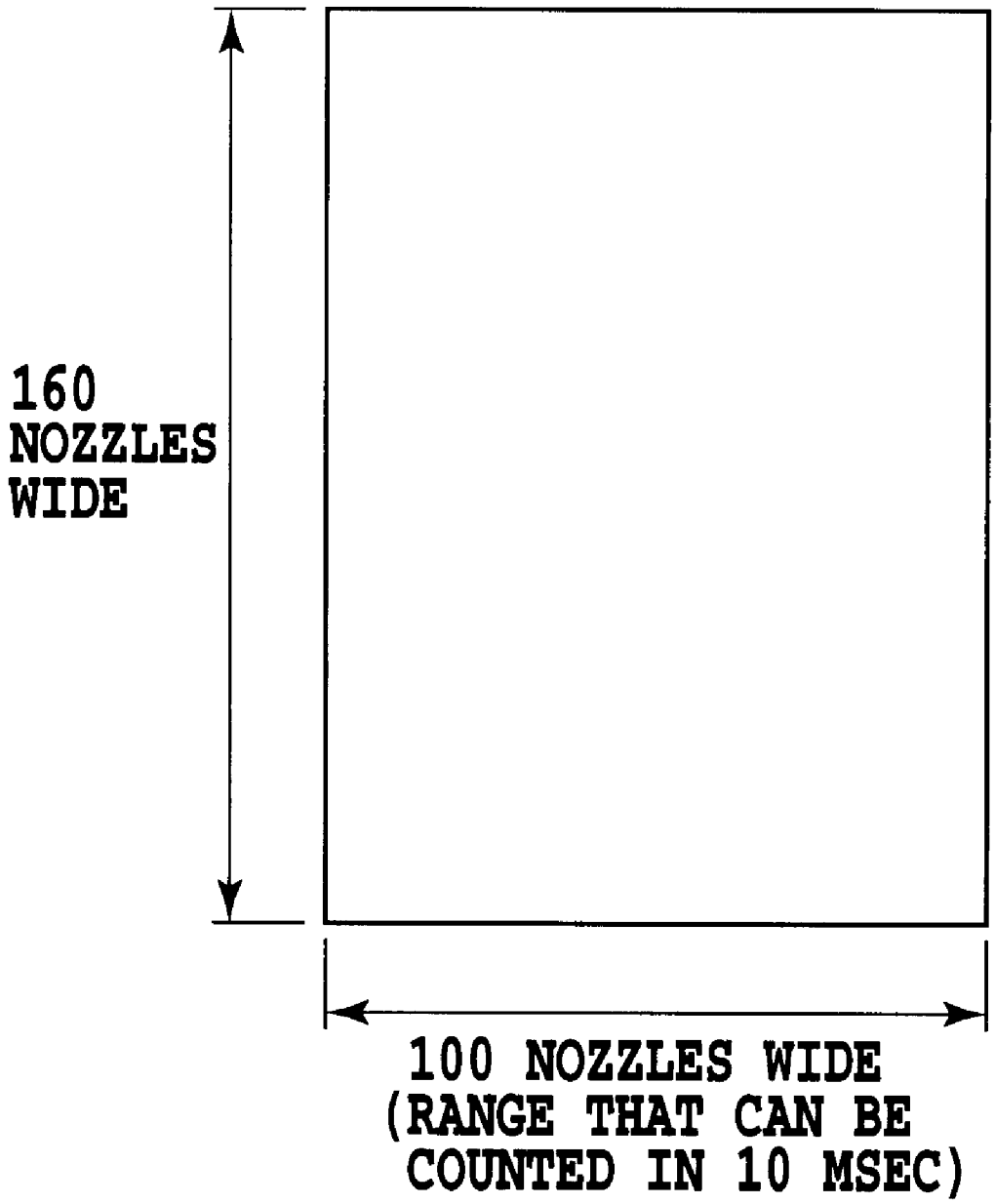
FIG. 15 is a diagram showing a dot count area for determining a print duty in the ink jet printing apparatus as one embodiment of the invention.

In this embodiment, in which the print head used is 160 nozzles wide as shown in FIG. 15, the number of ejected dots is counted for the duration of each 10 msec (this duration corresponds to a width of 100 dots when the drive frequency for ejecting ink from nozzles is 10 kHz) to calculate the print duty of the printed area based no the count value and the duration (10 msec). The total number of dots in a detection area is 160×100=16,000 dots, and the print duty is taken as 100% when the detection area has 16,000 printed dots. The detection area is not limited to the range described above and its range may be determined appropriately according to the number of nozzles provided in the print head or the drive frequency. The range may also be determined according to the processing capacity of the apparatus.

Figure 16A:
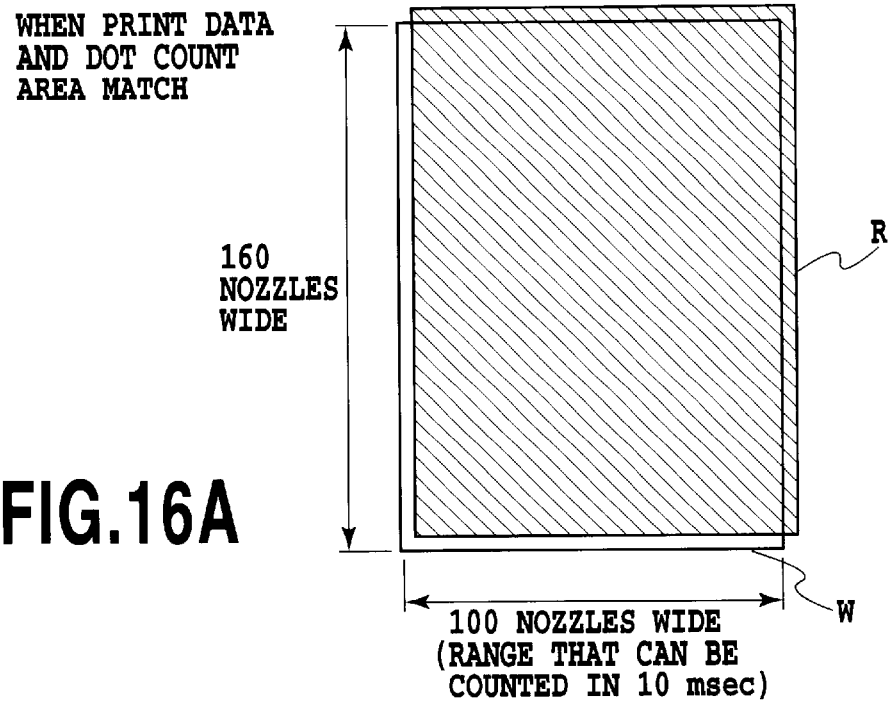
FIG. 16A is an explanatory diagram showing the dot count area for determining a print duty and an actual printed image in one embodiment of the invention when the printed image and the dot count area match.
Figure 16B:
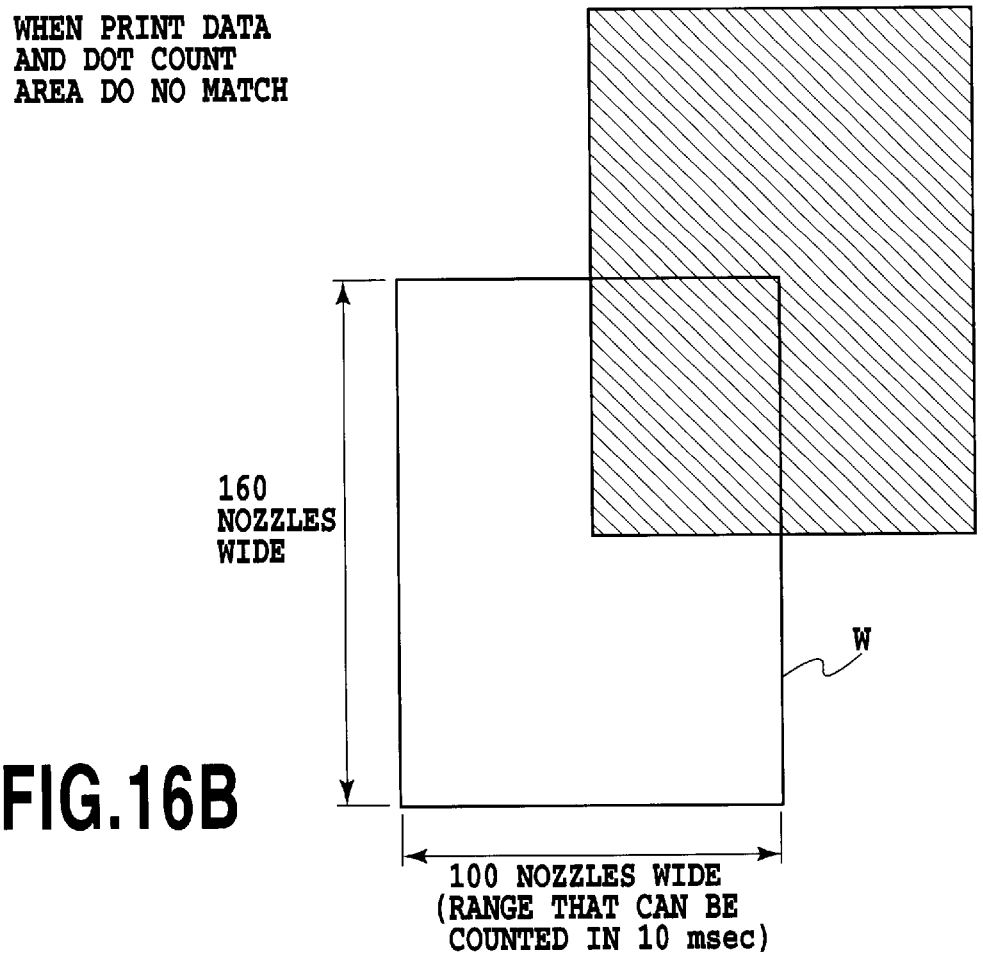
FIG. 16B is an explanatory diagram showing the dot count area for determining a print duty and an actual printed image in one embodiment of the invention when the printed image and the dot count area do not match.

In this case, when there are positional relations between the dot-printed area on the print medium and the dot count area W, as shown in FIG. 16A and FIG. 16B, different detection results are produced for the same printed area. This can cause a detection error.

FIG. 16A represents a state where the printed area R, in which solid printing was done at a 100% print duty coincides with the dot count area W completely overlap. In this case a 100% print duty is obtained as a detection result. On the other hand, FIG. 16B shows a case where the dot count area W is shifted 80 nozzles from the printed pattern in the sub-scan direction or paper feed direction and the read timing is deviated 5 msec in the main scan direction of the carriage. For the sake of illustrating both areas R and W, the printed area R and the dot count area W are shown somewhat staggered from each other.

If the printed area R of FIG. 16B has exactly the same print duty as that of the print area R of FIG. 16A, the detection result obtained from the count area W is a 25% print duty, which means that a detection error has occurred. Such a detection error is less likely to occur when the printed area R is larger in vertical and horizontal sizes than the dot count area W, as a result the detection accuracy of printing duty improves. Hence it is very effective to reduce the size of the dot count area W as by dividing the dot count area in the nozzle column direction or by shortening the interrupt intervals. Further, when the dot count area W is small in size, detection errors, if any, will occur for very small solid-printed areas that have relatively good ink fixing performances. Therefore, it is unlikely that any problem will arise in preventing a discharged paper-induced smear.

However, setting the dot count area W too small may carry an undesired possibility that a high print duty may be detected even for such areas with small print duties as texts. Such inconveniences may be avoided by accumulating the detection results for the small dot count areas W and determining as having a high print duty area that has a large number of dots.

Figure 17:
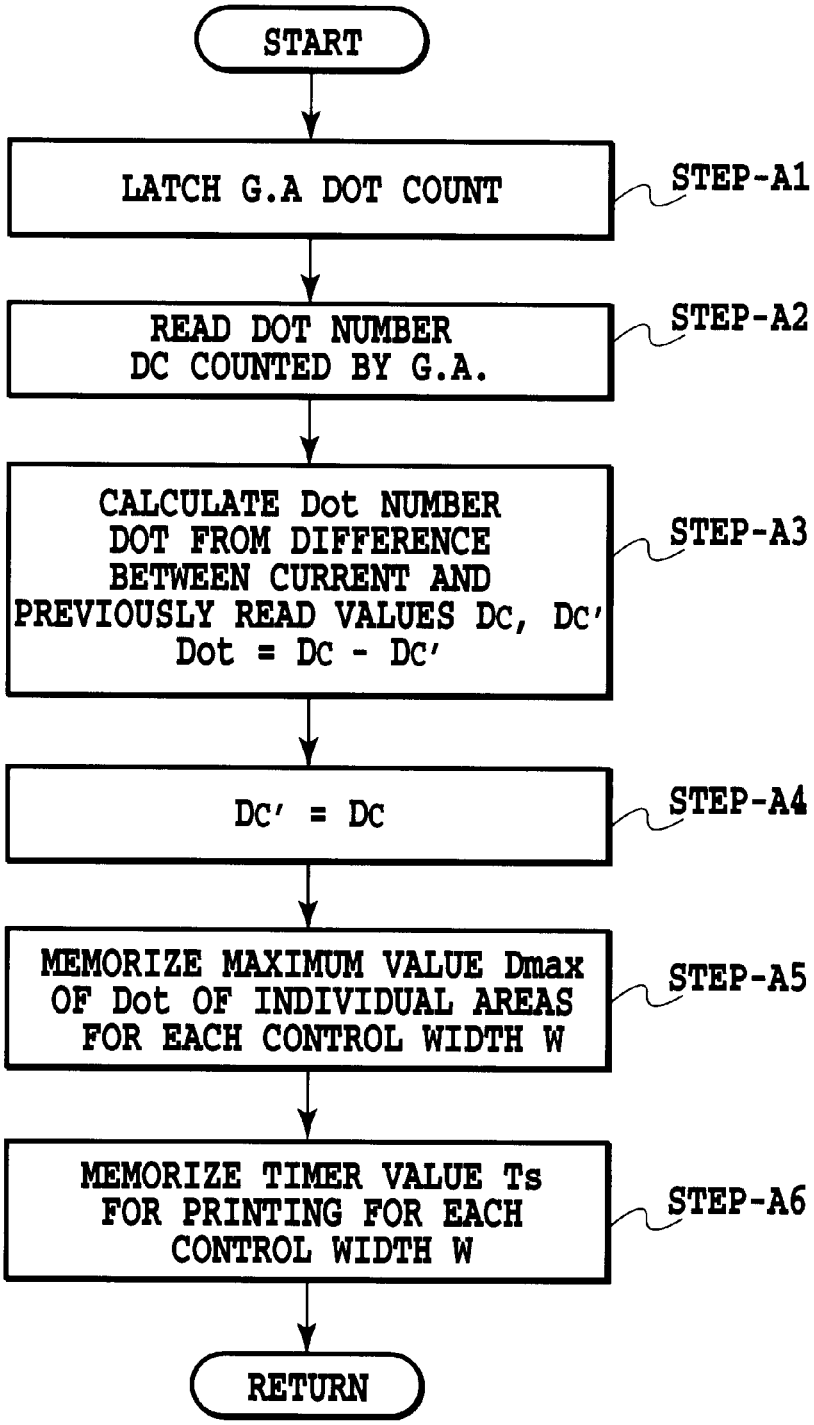
FIG. 17 is a flow chart showing a sequence of operations when a print duty is set in a first embodiment of the invention.

Next, based on flow charts shown in FIG. 17, FIG. 18 and FIG. 19, the discharged paper-induced smear prevention control in the first embodiment will be explained.

First, referring to FIG. 17, one example sequence of dot counting performed in each print area will be explained.

To detect areas printed with a print duty higher than a predetermined value, a dot counting is performed for each particular print area.

First, Step-A1 transfers the print data input through the interface 2210 to the gate array (G.A.) 2211 as dot data and then latches the dot data. This step then counts the number of dots in the latched dot data to determine the number of dots in an image to be printed. Next, Step-A2 reads the dot number Dc counted in the gate array 2211.

Step-A3 takes a difference between a previous dot count value Dc' and the latest dot count value Dc to calculate the number of dots Dot printed in a predetermined time. As an example, suppose a latch interval is set to about 10 msec and the drive frequency of the print head to 10 kHz. Then, the dot count can be performed for an area of 100 dots per raster.

Next, Step-A4 writes a newly read dot count value Dc over the previously read dot count value Dc'. Step-A5 memorizes for each control width W a maximum value Dmax of the dot numbers Dot counted in individual dot count areas. Each of the dot count areas is 160 dots long in the nozzle column direction, as described earlier. That is, in this process, the dot count can be performed for an area of 160×100 dots during the latch interval of about 10 msec. The control width W corresponds to a distance by which the print medium is fed intermittently in the sub-scan direction.

Finally, Step-A6 memories the printing time Ts for each control width W. Here, the time Ts is measured by using a timer incorporated in the MPU 2214. In this way, the maximum dot number and the printing time are stored in memory for each control width W.

Figures 18, 18A:
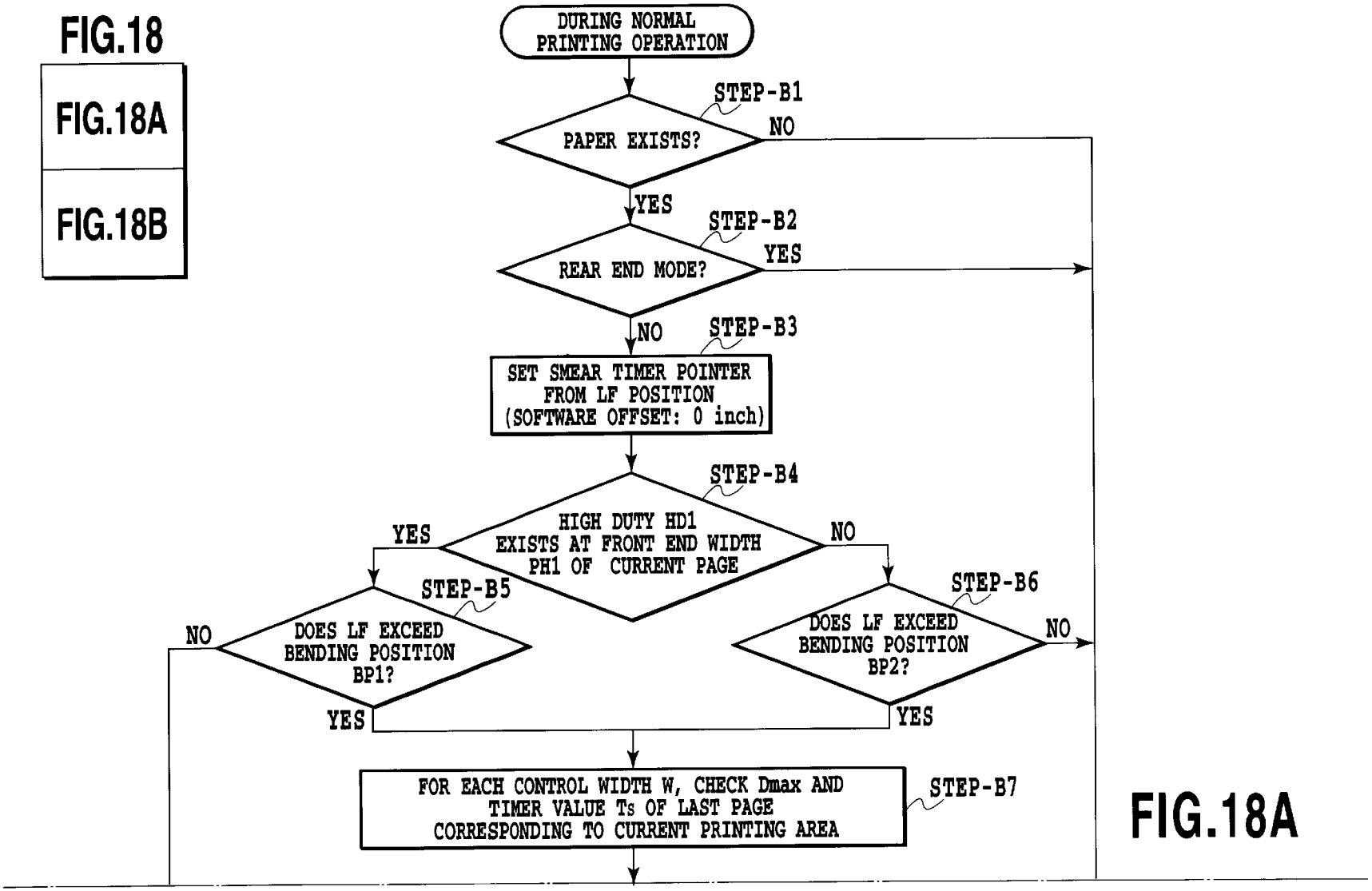
FIG. 18 is a flow chart showing the relationship of FIGS. 18A and 18B.
FIG. 18A is a flow chart showing a sequence of operation when a normal printing operation is performed in the first embodiment of the invention.
Figure 18B:
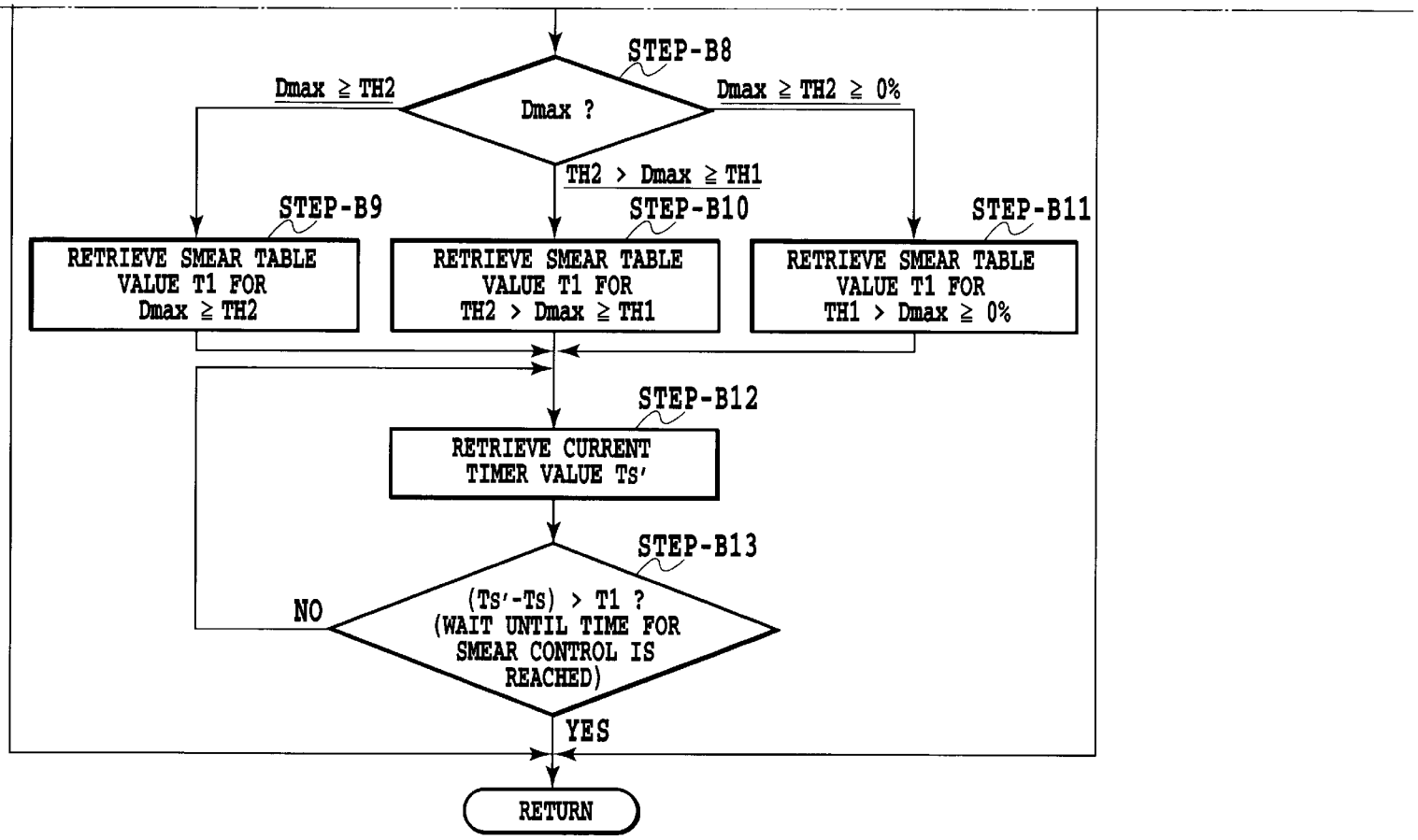
FIG. 18B is a flow chart showing a sequence of operation when a normal printing operation is performed in the first embodiment of the invention.
Figures 19, 19A:
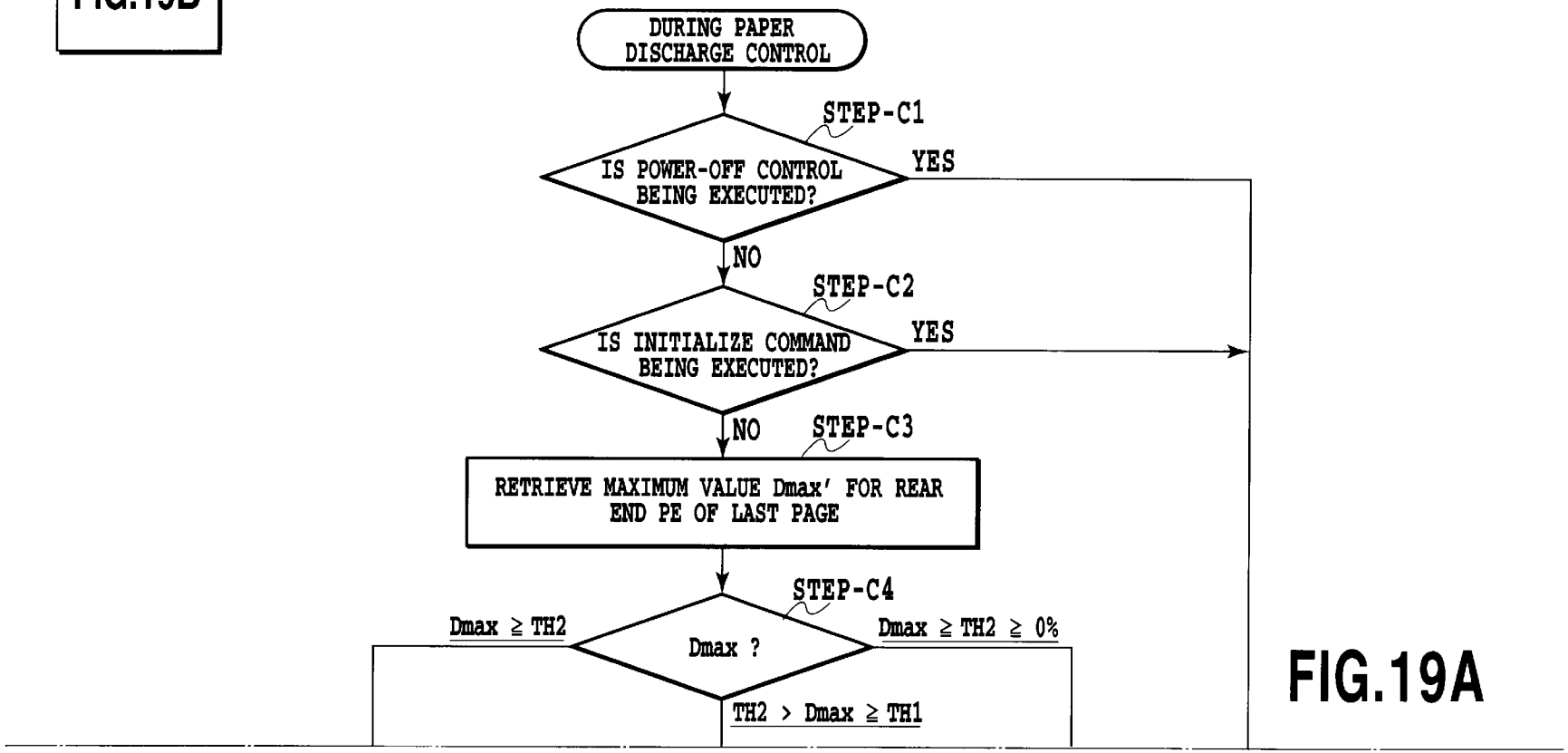
FIG. 19 is a flow chart showing the relationship of FIGS. 19A and 19B.
FIG. 19A is a flow chart showing a sequence of operations when a printed sheet discharge control is performed in the first embodiment of the invention.
Figure 19B:
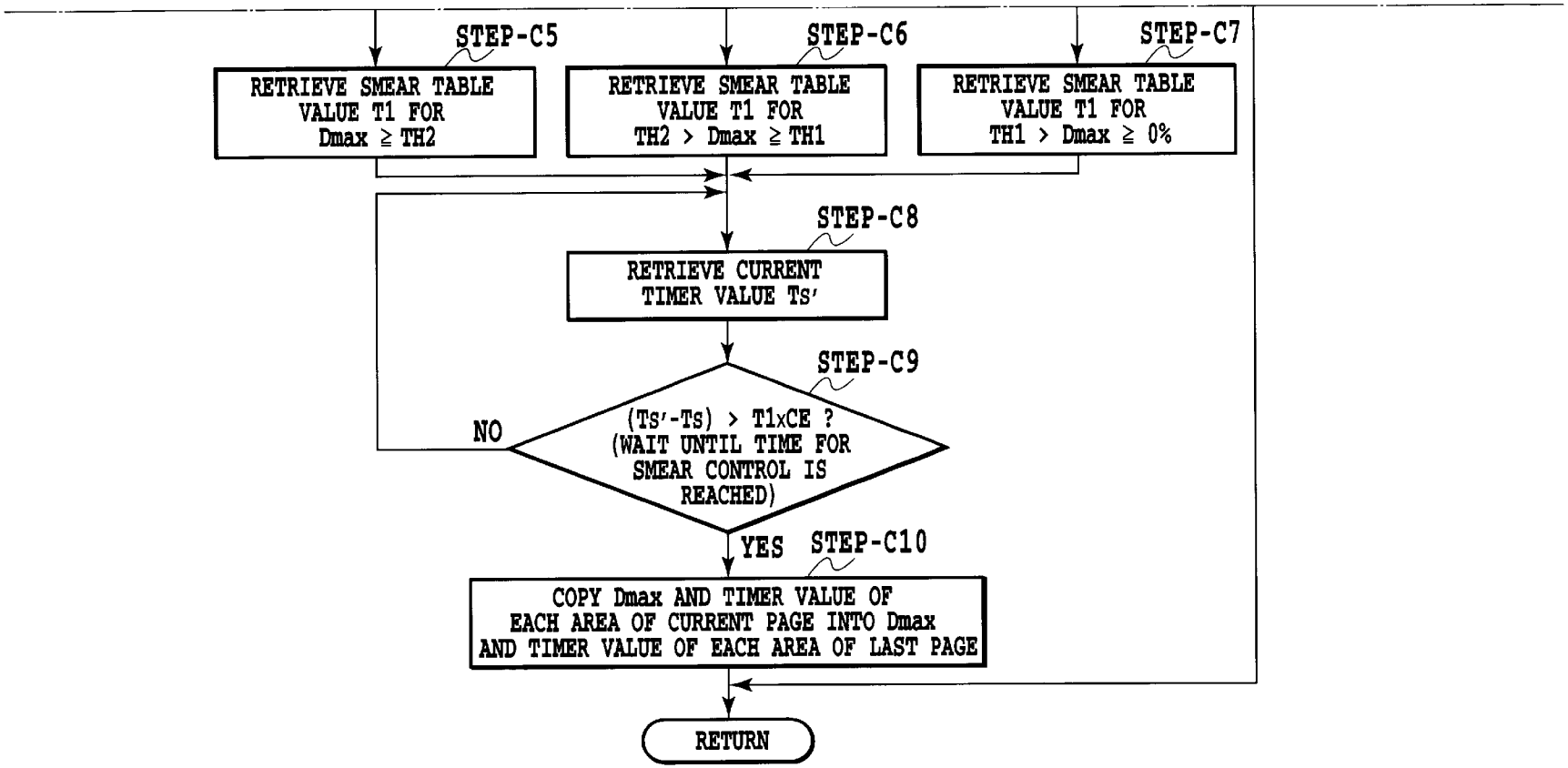
FIG. 19B is a flow chart showing a sequence of operations when a printed sheet discharge control is performed in the first embodiment of the invention.

FIG. 18 is a flow chart showing a sequence of discharged paper-induced smear prevention control during the normal printing operation. The sequence shown here is performed for each control width W.

In FIG. 18, Step-B1 checks whether there is any print medium currently being printed in the printing apparatus. If no print medium is currently being printed, this sequence is terminated.

If such a print medium exists, the control sequence proceeds to Step-B2 where it checks whether a paper end mode is active. When the paper end mode is active, this sequence is ended and the control is transferred to the smear prevention control during the paper discharging operation described later.

When the paper end mode is not active, this sequence is continued. Step-B3 sets a pointer for a smear timer to start from the print medium feed start position (LF position) in order to store the printing time in memory for each control width W.

Next, Step-B4 checks whether there is a printed area with a high print duty HD1 at a front end of the print medium currently being printed (current page). The front end width PH1 is a value that can be determined according to the characteristic of the print medium and, in this sequence, is set to 3 inches. Here, the high print duty refers to a print duty of 60% or higher. The actual value of the high print duty should be determined according to the characteristics of an ink used. For an ink which quickly soaks into the print medium, the high print duty is preferably set small; and for an ink with a slow penetration performance, it is preferred that the high print duty be set relatively large.

When Step-B4 decides that a print area with a high print duty exists, the control sequence moves to Step-B5. When such a print area does not exist, the control sequence proceeds to Step-B6. Step-B5 and Step-B6 each check if the front end of the current page has passed a paper bending position BP1, BP2. The paper bending position varies depending on the size of the print medium. In this invention the paper bending position is changed according to a lateral width of the print medium used (i.e., width of the print medium as measured in a direction perpendicular to the paper feed direction (sub-scan direction)) or a main scan width.

Figure 23A:
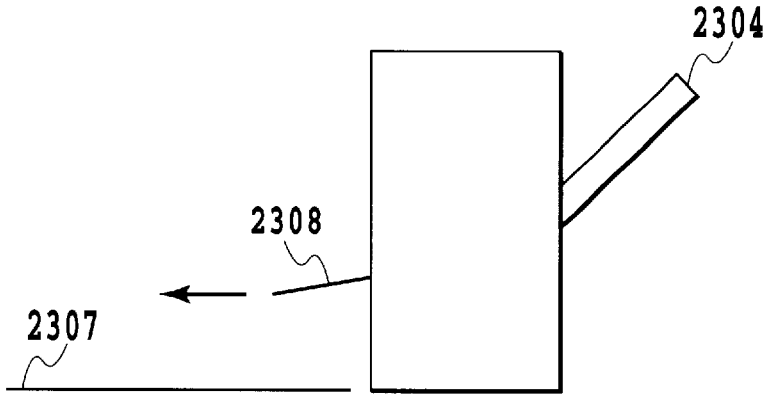
FIGS. 23A, 23B and 23C are explanatory diagrams showing positional relations between a discharged print medium and a print medium being printed in an ink jet printing apparatus that can apply this invention.
Figure 23B:
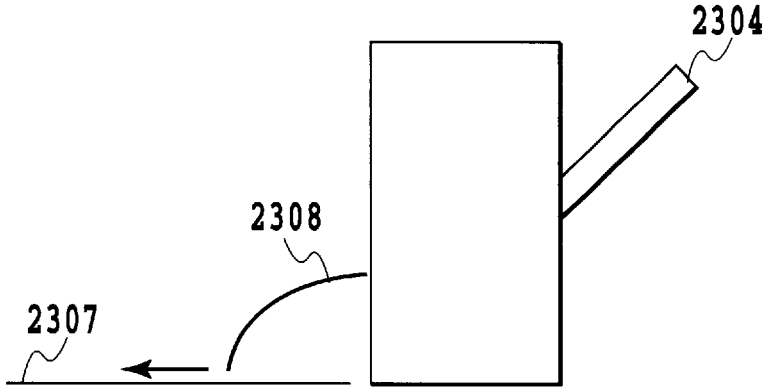
Figure 23C:
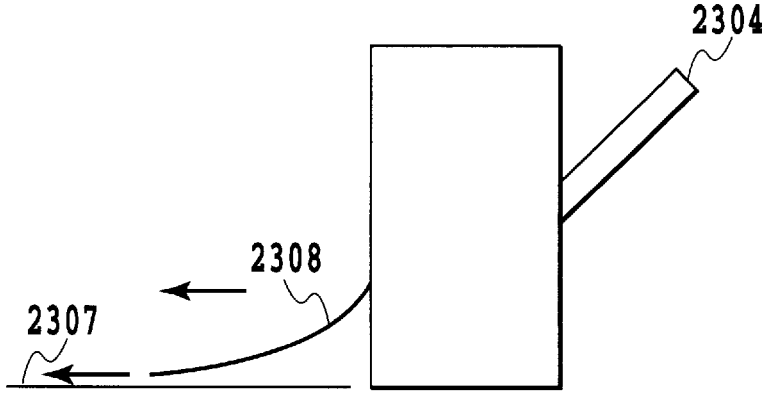

FIG. 23A, FIG. 23B and FIG. 23C show print mediums being discharged by the printing apparatus. FIG. 23A shows a state in which, following the last printed medium (last page) P1 that was printed and discharged onto the discharge position, the next print medium currently being printed (current page) P2 is discharged about 2 inches from the apparatus. FIG. 23B shows a state in which the printing process has proceeded further and the current page P2 is discharged about 4 inches, with its front exposed portion P2*a* bent and its front end contacting the last page P1. The point at which the front end of the current page P2 contacts the last page P1 varies depending on the size of the current page. That is, the point at which the discharged paper-induced smear occurs differs. This embodiment takes this fact into consideration in optimizing the timing at which to perform the smear prevention control. FIG. 23C shows a state in which the printing process has proceeded further more and a paper end sensor has detected the paper end. At this point a smear may occur on the last page P1.

One example of setting the paper bending positions in the current page P2 is shown in FIG. 24.

In FIG. 24, the paper bending positions BP1, BP2 are set for each paper size A5, A4 and A3. The weight of the front exposed portion P2*a* of the current page P2 increases as the lateral width of the current page P2 increases. Hence, a distance from the front end of the current page P2 to the paper bending positions BP1, BP2 at which the current page P2 is likely to bend by the weight of the front exposed portion P2*a* is considered to become shorter as the paper size increases. Based on this assumption, the bending position setting is made. Further, if the printed medium has high print duty areas, the bending position setting is done by assuming that the paper bending will occur at still shorter positions. The front exposed portion P2*a* of the current page P2 refers to that part of a front portion projecting forwardly from the platen which is not supported by such a support member as the discharged paper support mechanism.

Here again, our explanation returns to the discharged paper-induced smear control during the normal printing operation. If Step-B5 and Step-B6 find that the paper feed distance does not exceed the paper bending position, this sequence is ended.

Step-B7 references the maximum dot number Dmax and the timer value Ts for an area in the last page P1 which corresponds to the front end position of the current page P2. The corresponding area in the last page P1 means an area in the last page with which the front end of the current page P2 is likely to come into contact when the current page P2 droops down as shown in FIG. 23B, i.e., an area in the last page P1 where the discharged paper-induced smear may be caused by the front end of the current page P2 contacting the last page P1.

Then, the ink fixing state of the area in the last page P1 under consideration is checked by referencing the maximum dot number Dmax and the timer value Ts.

Next, Step-B8 determines a value of the print duty corresponding to the referenced maximum dot number Dmax. If the print duty value is equal to or higher than a threshold value TH2, the control sequence moves to Step-B9. If the maximum dot number Dmax is equal to or higher than a threshold value TH1 and smaller than TH2, the control sequence proceeds to Step-B10. If the maximum dot number Dmax is smaller than the threshold value TH1, the control sequence moves to Step-B11. Then, according to the smear table, Step-B9 to Step-B11 each retrieve a time duration T1 considered necessary for the ink fixing.

Then, Step-B12 retrieves a timer value Ts' representing the time at which the current printing operation is being performed on the current page P2. Next, Step-B13 calculates a difference (time difference) between the timer value Ts' and the timer value Ts at which the printing operation was performed on the last page P1, and halts the printing operation until the calculated time difference exceeds the time duration T1 considered necessary for the ink fixing, at which time the printing operation is resumed.

An example smear table with the threshold value TH1 set at 30% and the threshold value TH2 at 50% is shown in FIG. 25. The table shows the time duration T1 considered necessary for the ink fixing in each print mode. The standby duration is shown for each print duty. The print modes 1, 2, 3 represent the ink fixing performances and are arranged in the descending order of the print duty, i.e., in the ascending order of ink fixing performance. For example, as shown in the print mode 3, the standby duration is set to 0 so that no standby operation is executed for a low print duty. The standby duration is set in accordance with the characteristic of each print mode.

Next, a sequence of the discharged paper-induced smear prevention control during the paper discharging operation will be explained by referring to a flow chart of FIG. 19. This control sequence is performed for each control width W.

First, Step-C1 checks whether a power-off control is being executed. If the power-off is being executed, this sequence is ended. If not, the control sequence proceeds to Step-C2. Step-C2 checks whether an initialize command is being executed. If the initial command is being executed, the sequence is ended. If not, the control sequence moves to Step-C3. Step-C3 retrieves a maximum dot number Dmax' in each printed area at the rear end PE of the last page.

Next, Step-C4 checks the print duty of the referenced Dmax'. If the Dmax' is equal to or higher than the threshold value TH2, the control sequence moves to Step-C5. If the Dmax' is equal to or higher than the threshold TH1 and smaller than TH2, the sequence moves to Step-C6. If the Dmax' is smaller than TH1, the sequence moves to Step-C7. Step-C5, Step-C6 and Step-C7 each retrieve a time duration T1 considered necessary for the ink fixing. Step-C8 retrieves a time Ts' at which the current printing operation is being performed on the control area.

Next, Step-C9 calculates a difference between the timer value Ts of the last page and the timer value Ts' of the current page being printed. This time difference represents a time duration required for the smear prevention. If the time duration has not elapsed, the printing operation is made to wait for more than a period of time which is determined by multiplying the time T1 considered necessary for the ink fixing with a correction coefficient CE (T1×CE). Next, Step-C10 copies the Dmax and the timer value of each area on the current page into the Dmax and timer value of the last page, before terminating this sequence.

As described above, unlike the smear prevention control during the normal printing operation, the smear prevention control during the paper discharging operation does not control the occurrence of smear caused by the front end of the current page P2 rubbing the last page P1, but prevents smear which is caused, when the current page P2 is discharged and parted from the printing apparatus, by the rear end portion of the current page P2 overlapping and contacting the rear end portion of the last page P1, disturbing the printed surface of the last page P1 or smearing the back surface of the current page P2.

Since the smear prevention control during the paper discharging operation is performed to prevent the undesirable effects as mentioned above after the current page P2 is completely discharged, the time taken from the discharging of the last page P1 to the starting of the control is longer than that taken by the smear prevention control during the printing operation which prevents smear caused by the front end of the current page P2 rubbing the last page P1. Therefore, the correction coefficient can be set so as to reduce the fixing time required of the smear prevention control during the paper discharging operation.

The range of the rear end PE of the last page P1 varies depending on the size of the print medium. In this embodiment the range of the rear end can be changed according to the size of the print medium used or the print scan width. Further, the correction coefficient of the smear prevention control during the paper discharging operation can also be changed according to the size of the print medium or the print scan width. One example of setting this range is shown in FIG. 26.

FIG. 26 shows the rear end width PE and the correction coefficient CE for three print medium sizes A5, A4 and A3. As the size of the print medium increases, the ink fixing at the rear end portion of the last page P1 proceeds further. Hence, the rear end range of the current page P2 can be set small and the correction coefficient for the smear prevention control during the paper discharging operation can also be set small.

Figure 20:
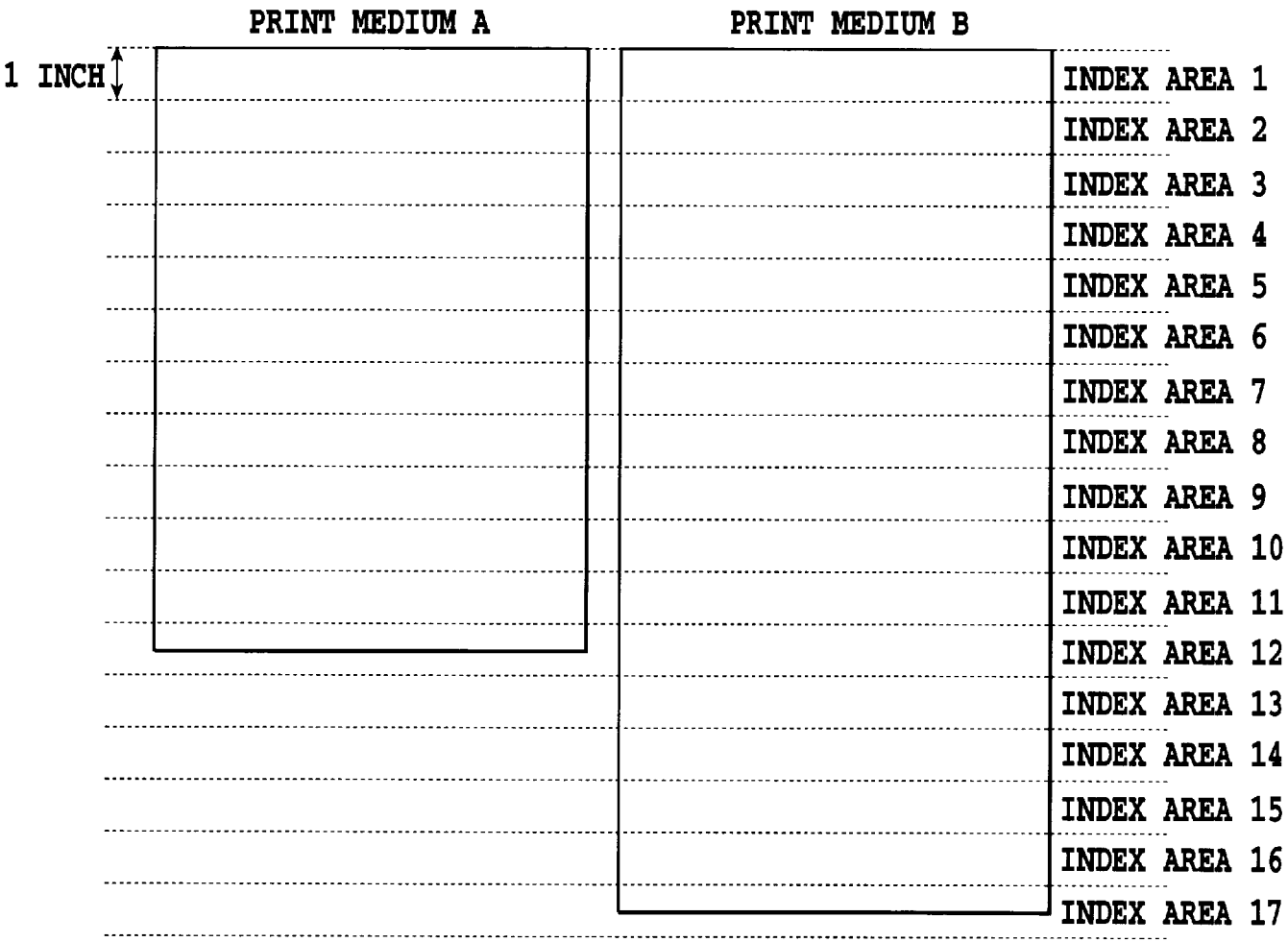
FIG. 20 is an explanatory diagram showing a control width on a print medium in the first embodiment of the invention.

In this embodiment, area numbers are assigned as shown in FIG. 20 and, according to these area numbers, the length in the sub-scan direction of a particular kind of print medium is detected.

That is, the print medium area is divided at equal intervals of one inch in the sub-scan direction; when the paper supply operation is started, the index areas begin to be counted; and according to the count value, the length of the print medium in the sub-scan direction is determined. For example, by counting the paper feed operations from when the paper began to be supplied until it passes a paper end sensor, it can be known that a print medium A in FIG. 20 is 12 inches long and extends to an index area 12. In this embodiment that assumes the maximum length of the print medium to be within 17 inches, the memory has a capacity equivalent to 17 index areas.

A print medium B can be determined to be 17 inches long, which is the maximum length. The memory capacity required can be determined by assuming the maximum length of the print medium supported by the printing apparatus.

Figure 21:
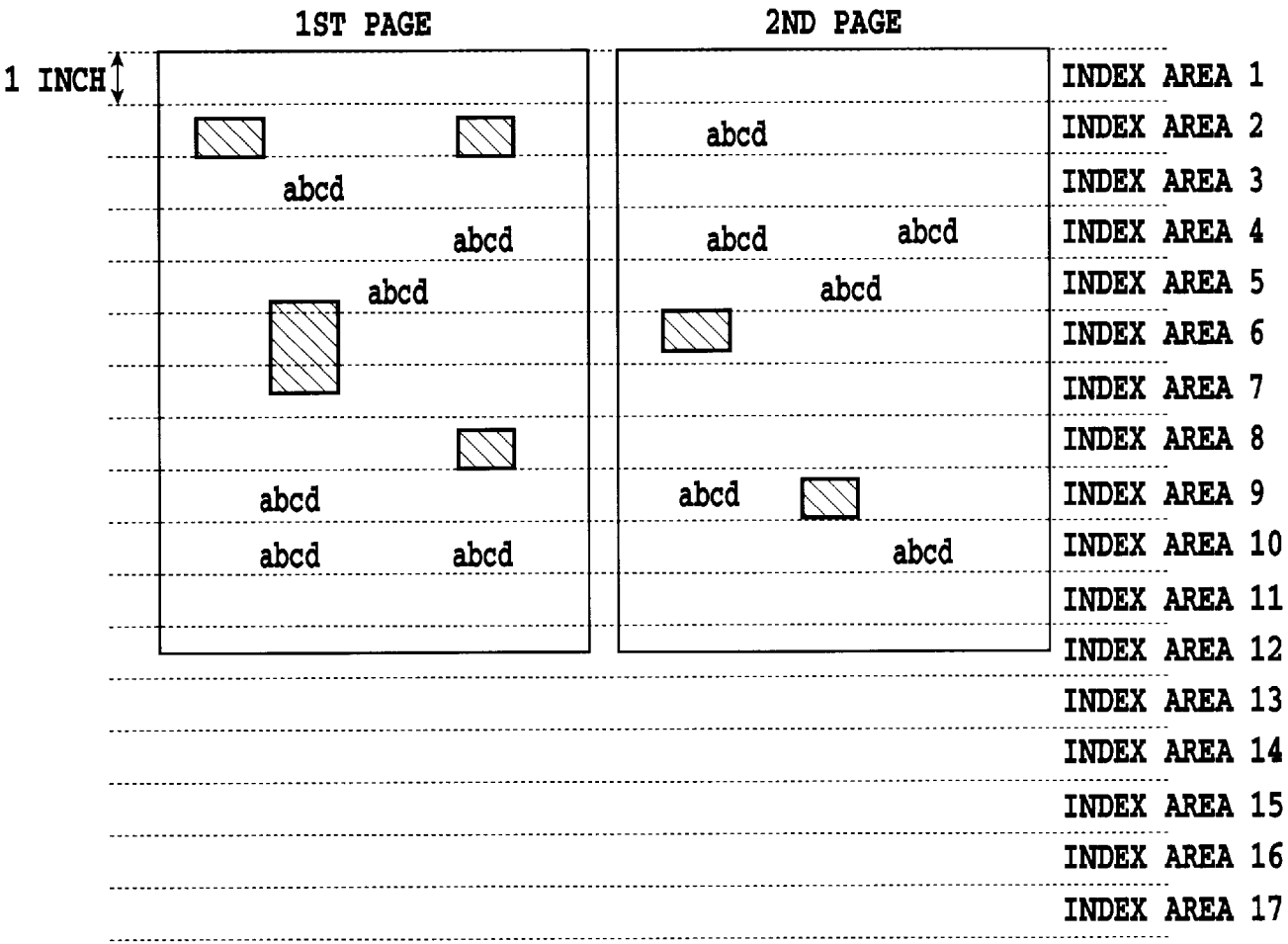
FIG. 21 is an explanatory diagram showing printed dots on continuously printed print mediums.

FIG. 21 shows a case where two successive pages of print medium A of FIG. 20 are printed with a mixture of print data having a high print duty such as used in solid printing and print data having a low print duty such as used in text data printing. For the printed portions in each page with a high print duty, i.e., for the solid printed portions, the smear control is performed. For the text portions the smear control is not performed. More specifically, in the first page the smear control is executed on index areas 2, 6, 7 and 8. In a solid printed portion at a central part of the first page that spreads over a plurality of index areas, the way the dot count value is reflected may vary depending on the positional relation among the print data, the dot count area and the control width. Even in a single continuously printed image, the smear control may be done in index areas 6 and 7 but not in an index area 5 because the maximum number of printed dots in the index area 5 is small.

Figure 22:
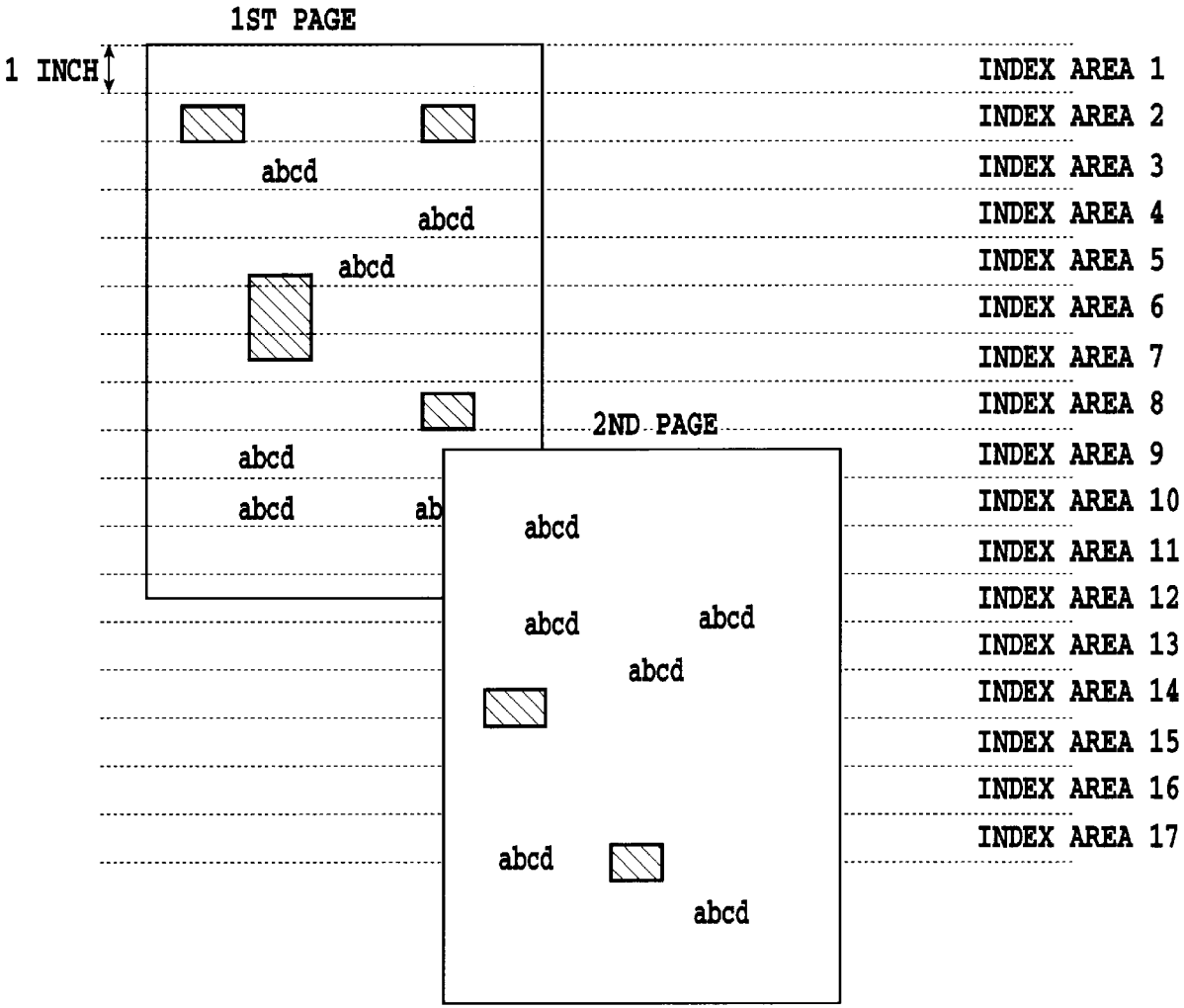
FIG. 22 is an explanatory diagram showing a plurality of continuously printed print mediums overlapping each other.

FIG. 22 shows an example timing at which to perform the smear control on the two pages of printed data shown in FIG. 21. The second printed page is stopped when its front end reaches an index area 9 of the first page to perform the smear control for the solid printed portion in an index area 8.

The smear control for the index area 8 may also be executed when the front end of the second page comes to an index area 10.

As described above, the discharged paper-induced smear prevention control performed in this embodiment involves checking whether the last printed page includes any high print duty portion, calculating a position of the high print duty portion and a required ink fixing time it will take for the printed portion in question to become free from smear, checking whether the ink on the high print duty portion of the last page is already fixed before the next page or current page passes over the high print duty portion, and, if the ink on that portion is fixed, permitting the printing of the current page to be continued without reducing the printing speed. It is thus possible to perform high-speed printing while preventing a discharged paper-induced smear.

Only for those printed portions on the last page where ink fixing is not complete and thus the discharged paper-induced smear is likely to occur, a delay printing is activated to suspend the current page printing before the current page reaches the printed portions in question in order to allow for additional time for ink fixing. This can prevent the discharged paper-induced smear and at the same time ensure that the current page can pass over the printed portions immediately after their ink fixing is complete. Further, setting the smear control activation timing and the control parameter for the paper discharge operation according to the size of the print medium enables efficient performance of the smear control.

There are areas in the front end portion and rear end portion of the print medium where smear is unlikely to occur because of the structure of the printing apparatus. These areas may also be taken into consideration in performing an effective smear control and assuring satisfactory image formation. When compared with the conventional printing apparatus, the printing apparatus of this invention can prevent the discharged paper-induced smear efficiently without having to install a thermal ink fixing device or a complicated paper discharge mechanism. This invention is particularly advantageous for application to a small portable ink jet printing apparatus.

Second Embodiment

Next, a second embodiment of the present invention will be described.

The second embodiment performs the discharged paper-induced smear prevention control to efficiently prevent possible smear when the discharged paper supports 104–108 described with reference to FIG. 1 to FIG. 13 are operated.

The discharged paper-induced smear prevention control performed in this embodiment of the ink jet printing apparatus is equivalent to that of the first embodiment.

The discharged paper supports 104–108 can be located at a plurality of desired positions according to the size of the print medium used, as described earlier. Hence, not only the capability of holding the discharged, printed medium but also the point in the printing operation at which the printed medium reaches the discharge tray will vary depending on the size of the print medium. Further, these factors will also change depending on whether the discharged paper supports 104–108 are operated or not. Furthermore, they also depend on whether there is any printed portion with a high print duty where the front end of the current page will land. In this embodiment, therefore, in each of the cases where the discharged paper supports 104–108 are operated and where they are not operated, the paper bending positions are set according to the size of the print medium used or the printing scan width, as shown in FIG. 27.

In FIG. 27, three print medium sizes A5, A4 and A3 are shown and, in each size, the paper bending positions BP1, BP2 are set for each of the operation positions of the discharged paper supports. The weight of the front end portion of the paper increases as the lateral width of the paper increases. To prevent the paper bending position from progressively approaching the paper end by the increasing weight, this embodiment is so set as to improve the strength of holding the discharged paper as the paper width increases. This arrangement will be explained by referring to FIG. 3, a perspective view that illustrates an overall construction of the printing apparatus.

In FIG. 3 the discharged paper supports 104–108 are intended to support a print medium of A3 size and therefore these five discharged paper supports can function effectively when used for an A3-size print medium or those close to that size. In that case, the print medium holding force is maximum. On the other hand, when an A4-size print medium is used, only three discharged paper supports 104, 105, 106 function. In that case, the print medium holding force decreases, though slightly, when compared with that for the A3-size print medium.

Further, in the case of an A5-size print medium, only two discharged paper supports 104, 105 are used, supporting only one side of the medium. In the case of hard print mediums such as post cards in particular, the performance of discharging the printed mediums may deteriorate. In this embodiment, therefore, the discharged paper support mechanism is not operated for print mediums of A5 size or smaller.

As shown in FIG. 27, for each of three sizes A5, A4, A3 of print medium, the distances from the paper end to the paper bending positions BP1, BP2 gradually increase as the size of the print medium increases whether the discharged paper supports are used or not. Particularly when there is no printed area with a high print duty at the front portion of the current page, the paper-end-to-paper-bending-position distance BP2 is set very long. That is, since the timing of performing the discharged paper-induced smear prevention control can be delayed, the control can be performed only for those portions requiring it.

As described above, the timing of performing the discharged paper-induced smear prevention control can be set according to the size of the print medium and the paper discharging state, i.e., the state of the discharged paper supports. This enables an efficient execution of the smear control, which in turn allows the maximum printing speed of the apparatus to be used effectively.

Others

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. The present invention, regardless of a type of printing heads, can be applied to various type of printing heads which are employed with corresponding type of ink jet printing apparatuses, respectively.

The present invention can be also applied to a so-called full-line type recording head whose length equals the maximum length across a recording medium.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable.

The number and type of recording heads to be mounted on a recording apparatus can be also changed. For example, only one recording head corresponding to a single color ink, or a plurality of recording heads corresponding to a plurality of inks different in color or concentration can be used.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for forming images by ejecting ink from a print head on to print mediums, said apparatus comprising:

discharging means for discharging printed mediums successively to a predetermined discharge position;

duration determining means for determining, based on an amount of ink ejected per unit area onto a preceding print medium last discharged to the discharge position by the discharging means, a required time duration that needs to elapse before a subsequent print medium being discharged from the discharging means toward the discharge position is allowed to contact a predetermined area of the preceding print medium;

speed control means for controlling a printing speed on the subsequent print medium so that the subsequent print medium will not contact the predetermined area of the preceding print medium within the time duration determined by the duration determining means;

size detection means for detecting a size of the print mediums; and modifying means for changing a timing of performing the printing speed control on the subsequent print medium based on a detection result produced by the size detection means.

2. An ink jet printing apparatus as claimed in claim 1, further comprising:

main scan means for moving the print head relative to the print medium in a main scan direction; and sub-scan means for moving the print medium relative to the print head in a sub-scan direction perpendicular to the main scan direction;

wherein the main scan means and the sub-scan means are intermittently moved to perform a printing operation.

3. An ink jet printing apparatus as claimed in claim 1, wherein the speed control means controls the printing speed by executing at least one of steps of changing a main scan speed of the main scan means, changing a sub-scan speed of the sub-scan means, changing an interval of the intermittent operations of the main scan means and changing an interval of the intermittent operations of the sub-scan means.

4. An ink jet printing apparatus as claimed in claim 1, wherein the duration determining means comprises:

area detection means for detecting a heavily dotted areas on the preceding print medium which are applied with more than a predetermined amount of ink per unit area;

ink ejection amount detection means for detecting an amount of ink ejected to the heavily dotted areas detected by the area detection means; and duration determining means for determining, based on the amount of ink ejection detected by the ink ejection amount detection means, a time duration that needs to elapse before the subsequent print medium is allowed to contact the heavily dotted areas on the preceding print medium discharged to the discharge position.

5. An ink jet printing apparatus as claimed in claim 1, wherein the ink ejection amount detection means detects the amount of ink ejected per unit area by counting the number of dots printed per unit time.

6. An ink jet printing apparatus as claimed in claim 1, further comprising a memory means to store a content determined by the duration determining means.

7. An ink jet printing apparatus as claimed in claim 1, further comprising a memory means to store a content determined by the duration determining means together with positions on the print medium of the heavily dotted areas detected by the area detection means.

8. An ink jet printing apparatus as claimed in claim 1, wherein the modifying means comprises a table which stores, as claimed in a size of the print medium, a timing to control the printing speed on the subsequent print medium.

9. An ink jet printing apparatus as claimed in claim 1, wherein the duration determining means stores in a table for each print mode a time duration that needs to elapse before the subsequent print medium is allowed to contact the heavily dotted areas on the preceding print medium.

10. An ink jet printing apparatus as claimed in claim 1, further comprising a discharged paper support means for supporting the discharged print medium;

wherein the control means controls the printing speed on the subsequent print medium as claimed in an operation state of the discharged paper support means and a detection result produced by the size detection means.

11. An ink jet printing apparatus as claimed in claim 10, wherein the speed control means has modifying means which changes a timing of the printing speed control executed on the subsequent print medium independently in two cases where the discharged paper support means is operated and where it is not.

12. An ink jet printing apparatus as claimed in claim 1, wherein the print head generates a bubble in ink by using a thermal energy and ejects ink by an energy generated by the bubble.

13. An ink jet printing method for forming images by ejecting ink onto print mediums, said method comprising the steps of:

discharging the printed mediums successively to a predetermined discharge position;

determining, based on an amount of ink ejected per unit area onto a preceding print medium last discharged to the discharge position, a required time duration that needs to elapse before a subsequent print medium being discharged toward the discharge position is allowed to contact a predetermined area of the preceding print medium;

controlling a printing speed on the subsequent print medium so that the subsequent print medium will not contact the predetermined area of the preceding print medium within the time duration determined by the duration determining step;

detecting a size of the print mediums; and changing a timing of performing the printing speed control on the subsequent print medium based on a detection result produced by the size detection step.

* * * * *

UNITED STATES PATENT AND TRADEMARK OFFICE

CERTIFICATE OF CORRECTION

PATENT NO. : 6,623,093 B2
DATED : September 23, 2003
INVENTOR(S) : Takahashi et al.

It is certified that error appears in the above-identified patent and that said Letters Patent is hereby corrected as shown below:

Column 3,
Line 42, “of” should read -- view of --.

Column12,
Line 12, “wait” should read -- waits --.

Column 13,
Line 55, “10 kHz. Then,” should read -- 10 kHz, then, --.

Column 21,
Line 10, “a” should be deleted.

Signed and Sealed this

Seventeenth Day of August, 2004

JON W. DUDAS
*Acting Director of the United States Patent and Trademark Office*